United States Patent [19]

Deem et al.

[11] 4,302,004

[45] Nov. 24, 1981

[54] MOBILE AMUSEMENT RIDE

[75] Inventors: William C. Deem; Robert Esposito; Laurence L. Littler; Robert S. Sullivan, all of Jacksonville, Ill.

[73] Assignee: Eli Bridge Co Inc, Jacksonville, Ill.

[21] Appl. No.: 16,130

[22] Filed: Feb. 26, 1979

[51] Int. Cl.[3] ..... A63G 1/26

[52] U.S. Cl. ..... 272/29; 272/37

[58] Field of Search ..... 272/29, 37

[56] References Cited

U.S. PATENT DOCUMENTS

| | | | |
|---|---|---|---|
| 2,259,691 | 10/1941 | Harris | 272/37 |
| 3,078,090 | 2/1963 | Thomas | 272/29 |
| 3,767,194 | 10/1973 | Barber | 272/29 X |

FOREIGN PATENT DOCUMENTS

| | | | |
|---|---|---|---|
| 941022 | 11/1963 | United Kingdom | 272/37 |

*Primary Examiner*—Richard C. Pinkham
*Assistant Examiner*—Arnold W. Kramer
*Attorney, Agent, or Firm*—Rummler & Snow

[57] ABSTRACT

A self-contained amusement ride designed for use on a mobile unit can be folded into a compact assembly for highway transport. During operation of the ride, an angularly off-set undercarriage allows the front portion of the mobile unit to support the entire weight of the ride on the ground with essentially no weight on the rear wheels. A pivoted kingpin plate allows transport with adequate ground clearance and a retractable landing gear on the front end of the mobile unit provides for raising and lowering the mobile unit for connection and disconnection from a prime mover. Hydraulically assisted lockable supports tie the main sweep arms to the mobile unit during transit.

Pins with integral sliding hammers are provided to perform certain locking and pinning functions during assembly and disassembly of the ride. A single cylinder operates to pivot the top part of the main mast into and out of its support position and simultaneously raise and lower the lighting units on counterbalanced and spring biased linkages between the main mast and the unit masts. The ride incorporates three radially oriented units that rotate in one direction around the main mast, each radial unit carries four balanced seats that rotate in the opposite direction, around their unit masts. The folding, unfolding and locking of the seat sweeps is assisted by geometrically oriented and linked tie rods. The ride includes its own hydraulic operating circuit and set-up circuit.

14 Claims, 31 Drawing Figures

MOBILE AMUSEMENT RIDE

BACKGROUND OF THE INVENTION

Various forms of rotating amusement rides are known in the art. Generally these units are comprised of a multitude of separate parts that are bolted, clamped or otherwise fastened together piece-by-piece in assembly and then labriously unbolted and unclamped for storage in a truck or trailer for transport to the next location. This often envolves the use of unskilled manual labor and inevitably consumes considerable time. The various components and fasteners are designed for strength, reliability and ease of assembly, with safety of the passengers as the primary consideration. Some parts can be nested or folded and generally the components are oriented on the trailer in order of their sequence of use during the assembly. In spite of this, considerable amounts of time are consumed in the loading and unloading, inspection of the multitudinous fasteners and proper adjustment during operation, particularly as the size and complexity of the ride increase.

The instant assignee is the owner of U.S. Pat. No. 3,552, 747 which is directed to a mobile ferris wheel that folds up to a compact size on its own mobile bed and is readily and safely unfolded upon its pivotally-mounted mast to become a complete ferris wheel. The unit involves but one rotating part which is driven by a cable. The various spokes are bolted to the hub, but most of the remaining parts fold to a compact size without disassembly. Aside from the general idea of foldability the problems solved by and the laborsaving features incorporated in the instant invention have no relationship to the disclosure of said patent.

SUMMARY OF THE INVENTION

The instant invention provides a series of built-in labor-saving and safety features making it possible for two men to quickly and easily erect the amusement ride for operation from its own mobile bed or just as easily re-fold it for moving to the next location. The heaviest pieces to be handled are the seats and six of the twelve seats remain attached to their seat sweeps and unit poles at all times and do not need to be handled. All of the work in preparing the mobile unit on its location, erecting the main mast and lighing is accomplished by a self-contained hydraulic system. The amusement ride of this invention is only about 21 ft. high and operates in a 60 ft. by 60 ft. area. It has 12 seats providing a seating capacity of 24 to 36 passengers per trip. All lights, either fluorescent or incandescent, remain electrically and mechanically connected at all times, and those lighting panels which must be folded down for transit do so automatically when the top of the main mast is folded.

The entire unit meets the length, height and width requirements for highway travel. A self-contained, rear-mounted 12 HP gasoline engine is used to power the hydraulic equipment for setting up the ride and a 15 horsepower 3-phase electric motor operating a hydrostatic drive operates the unit after set-up.

DESCRIPTION OF THE DRAWINGS

An illustrative embodiment of the invention is shown in the drawings wherein.

DESCRIPTION OF A PREFERRED EMBODIMENT

Figure 1:
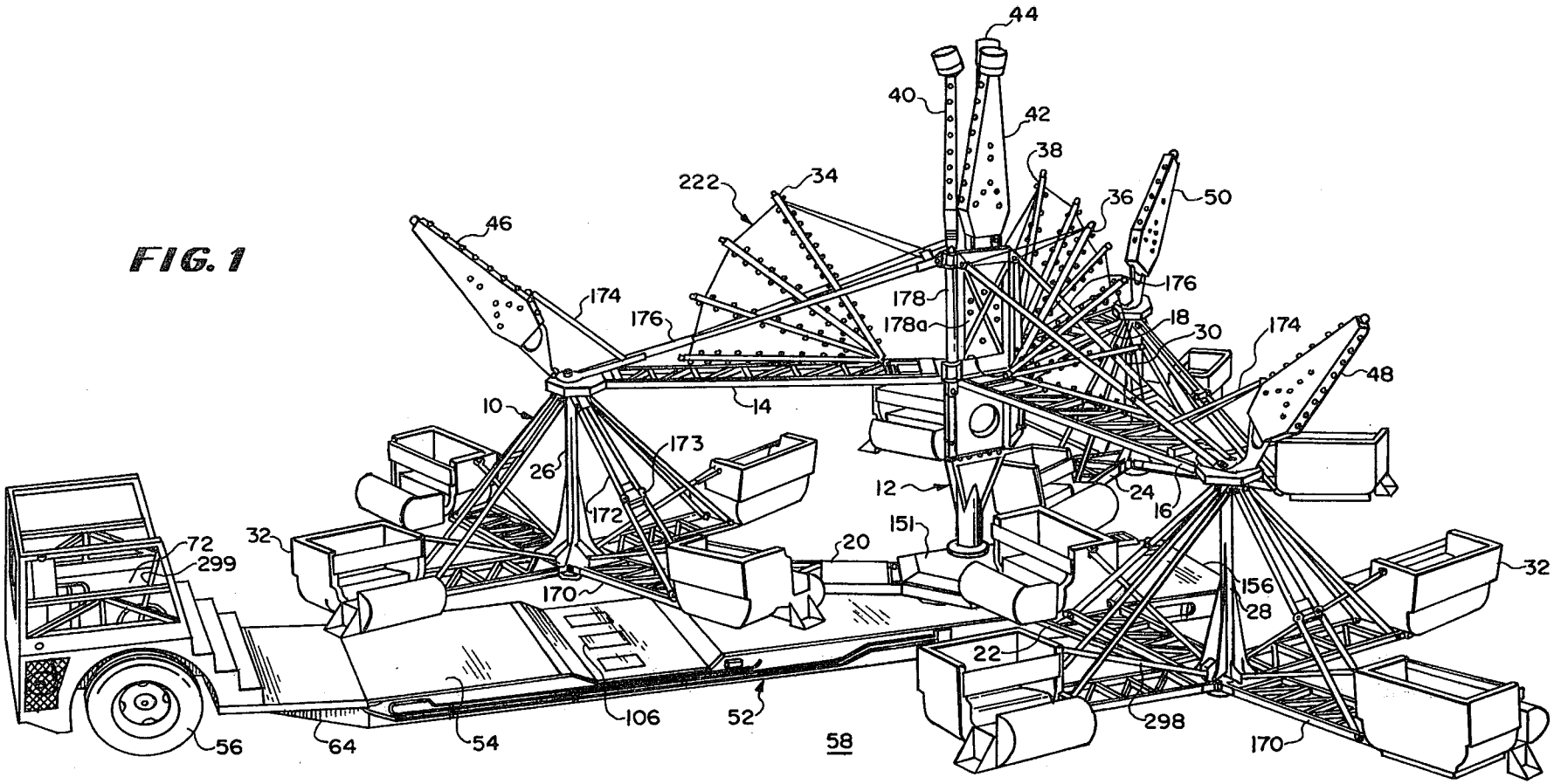
FIG. 1 is a perspective view of the amusement ride in the unfolded condition and ready for operation.

Referring to FIG. 1 the foldable amusement ride of this invention is shown set up in its operating position, same being designated in its entirety by the reference numeral 10. The moving parts of the ride 10 are supported from the main mast 12, which as will be described, holds the three upper unit sweeps 14, 16 and 18, and the lower unit sweeps 20, 22 and 24 in radially and circumferentially spaced positions. Each of these pairs of upper and lower unit sweeps e.g. 14–20, and 18–24, extend coplanar in radial relationship, at 120° spacing, from the main mast 12 and each pair has a unit mast 26, 28 and 30 rigidly and rotatably affixed in a vertical position between their extended ends. The radially extended upright unit masts 26, 28 and 30 provide a vertical rotational axis for the associated two-passenger seats 32 of which there are twelve. The three sets of four seats, may rotate in either direction and, to illustrate, may be rotated counter-clockwise, as viewed from above the unit 10, while the main mast 12 is rotated clockwise.

The foregoing assembly, including the masts, the fan light assemblies 34, 36 and 38, the top light panels 40, 42 and 44, the unit light panels 46, 48 and 50, is supported on the mobile unit 52 by means of the bed 54, and the pair of rear wheels 56. The ground location 58 for the ride 10 is generally level and is normally surrounded by a fence comprising a series of separable fence units, the legs of which are supported in the base members, none of which are illustrated since they do not form a part of the invention and same is supplied for required crowd control and safety, which requirement could be satisfied with any type of enclosure for the location 58.

Figure 2:
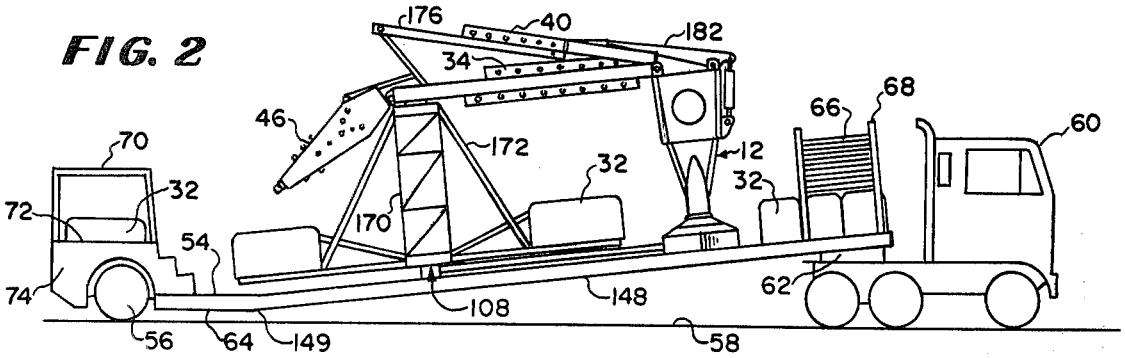
FIG. 2 is a partially diagramatic side view of the ride in its transport position.

FIG. 2 shows the right side of the ride 10 with its mobile unit 52 attached to a prime mover 60. During transport the rear of the bed 54 is supported by the rear wheels 56 and the kingpin plate 62 at the front end which is locked to the fifth wheel (not illustrated) of the prime mover. The bed 54 is thus carried at an angle during transit and proper road clearance is provided by the angularly off-set portion 64 in the bottom of the bed and extending forward of the rear wheels. Provision is made for the storage of the fence units as at 66 in a rack 68 above three of the seats 32 arranged in tandem along the front end of the bed 54.

A second rack 70 and platform 72 are provided at the rear of the mobile unit 52 as the control platform for the operator and for the storage of the remaining three seats 32, of the six that are removable, side-by-side across the floor of the rack 70.

Figure 3:
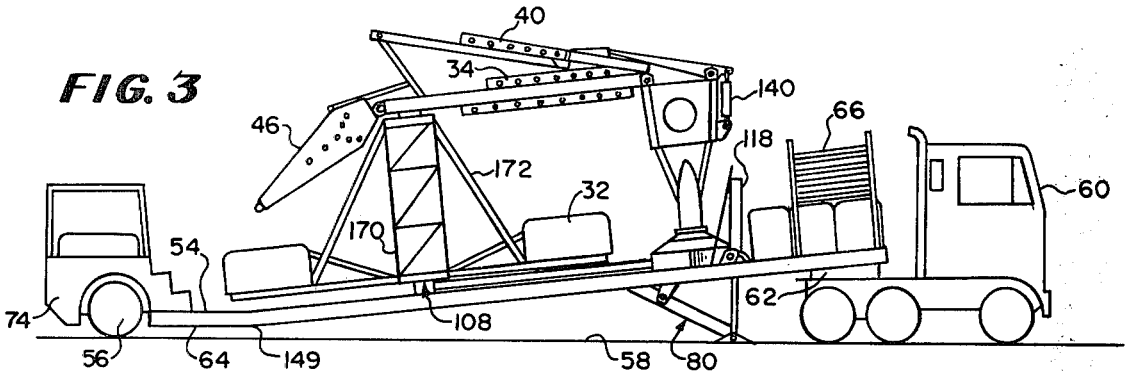
FIG. 3 is a view like FIG. 2 with the ride on location and with the front supports in position.
Figure 4:
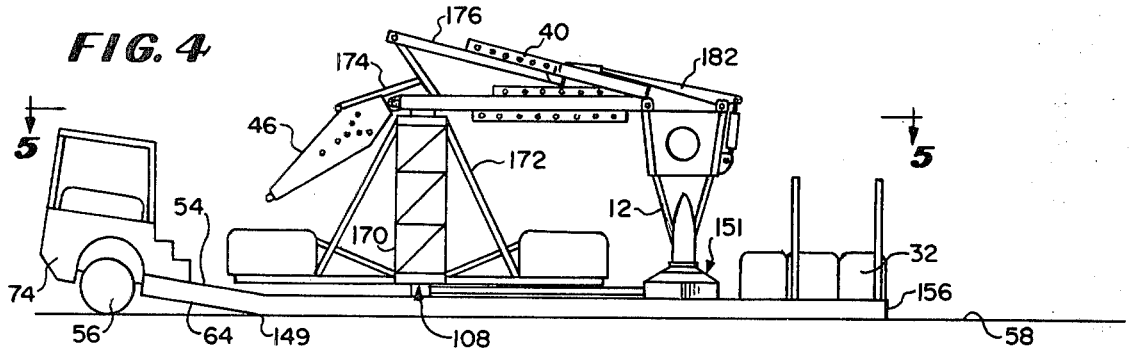
FIG. 4 is a side view like FIG. 3 with the prime mover removed and the mobile unit lowered on a location or grade.

FIGS. 2–4 show the rear compartment 74 housing the drive motors and related equipment and the endmost of the two sets of six seats 32 that remain attached to their folding sweeps and unit poles as well as the folding unit light panels of which only the panel 46 appears, the edges of the top panel lights 40 and the fan light assemblies illustrated at 34. The seats 32 are shown with canvas covers on in FIGS. 2 and 3.

In FIGS. 3 a landing gear assembly 80 (one on each side of the mobile unit) has been lowered to engage the location or grade 58 and take the greater share of the weight of the mobile unit from the prime mover.

The power system in the rear compartment 74 can include a gasoline motor for operating the hydraulic equipment for setting up the ride and an electric motor to power a hydrostatic transmission which powers a hydraulic motor that rotates the main mast and the three unit masts. These parts will be described in relation to FIGS. 12 and 13. All of the hydraulic valves and controls are mounted in the mobile unit 52 and a single control, located at one side of the rear rack 70, which doubles as an operator platform when the seats are removed, operates the hydrostatic transmission and the mechanical brakes to stop it.

The general steps in erecting the ride of this invention include:

1. Positioning the mobile unit at a chosen sight and starting the engine to power the set-up hydraulic system.
2. Extending the landing gear at the front of the mobile unit and disconnecting it from the prime mover.
3. Lowering the mobile unit to the ground.
4. Setting up the fence and disconnecting certain hold downs and cable restraints.
5. Raising the mast on the center pole to the vertical position.
6. Unfolding the unit pole sweeps to their operating position.
7. Folding the six stored seat sweeps to their down positions and installing the seat brace tie rods.
8. Attaching the six removable seats, and
9. Connecting the electrical power to the ride.

The location 58 for the ride 10 should be as flat as possible and free of obstructions. The ride is fairly flexible and can tolerate some irregularities as long as the proper clearances for the rotating parts are maintained. The structures involved in this invention are best described in order of their use during erection of the ride beginning with the hydraulic set-up circuit.

Figure 12:
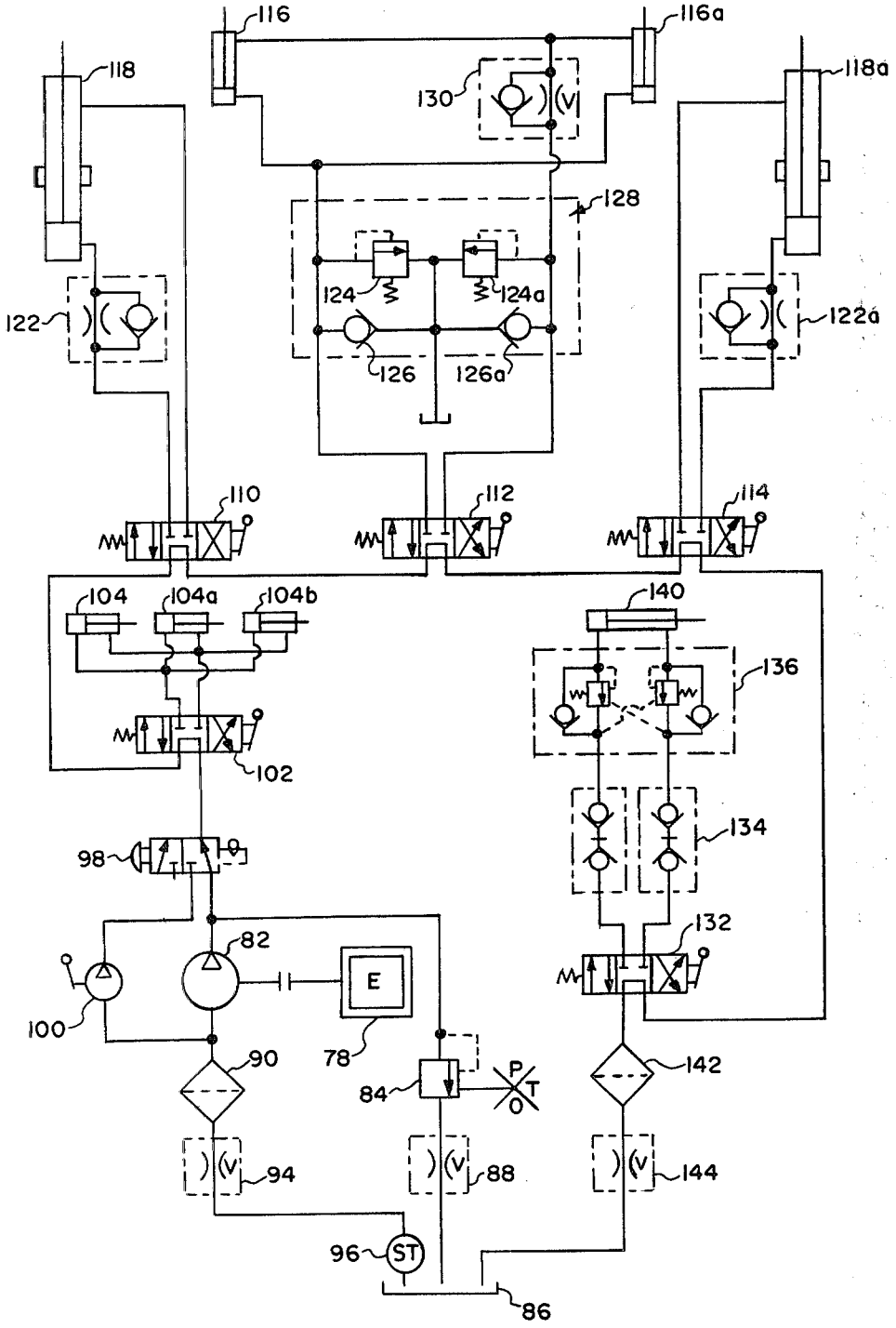
FIG. 12 is a diagram of the hydraulic operating circuit.

The hydraulic set-up circuit for ride is illustrated in FIG. 12 wherein the gasoline engine 78 drives the hydraulic gear pump 82 to provide hydraulic pressure and volume to the circuit, including the relief valve 84 which bleeds off excess pressure back to the oil reservoir 86 through the needle valve 88. The needle valve 88 is a backup in case the relief valve 84 should be blocked open by dirt particles. Such blockage would prevent the development of line pressure, unless the needle valve 88 is closed.

Figure 13:
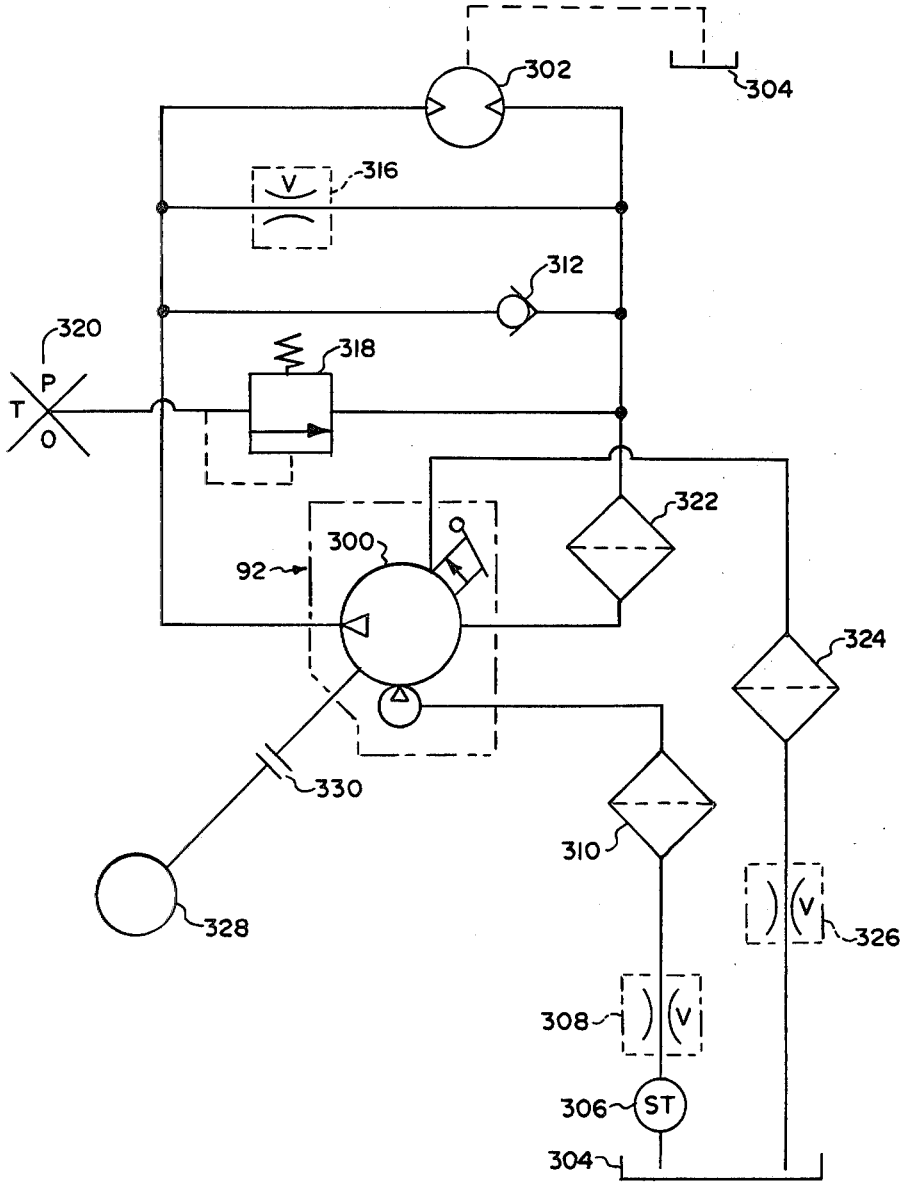
FIG. 13 is a diagram of the hydrostatic drive system for the ride.

The suction filter 90, the gate valve 94 and the strainer 96 serve the gear pump 82 and the charge pump of the hydrostatic transmission 92 (FIG. 13).

The position of the control knob on the selector valve 98 determines whether the pump 82 or the hand pump 100 will be ported to the rest of the hydraulic circuit. The control valve 102 controls the raising and lowering of the cylinders 104 (to be described), now folded under the cover plates 106, (see FIGS. 1 and 20) which temporarily lift the three unit poles 26, 28 and 30 to, and lower the poles from, locked travel positions in relation to a support block 108 (see FIGS.a 2–4, 7 and 8) as will be described. The unit pole cylinders 104 are connected on a common circuit and all three raise and lower together though not necessarily at the same time.

The hydraulic flow in the circuit continues to the stack valve 110–112–114 which controls the four cylinders that are involved in the landing gear operation, namely the small trunnion cylinders 116 and **116*a* and the larger main landing gear cylinders 118 and 118*a*. When the handle of the stack valve 112 is raised, the two cylinders 116 and 116*a* retract and each one of these cylinders, upon retraction, raises the trunnions 80 on each side of the mobile unit (see FIGS. 17 et. seq.) at the front end of the bed 54**.

Each of the main landing gear cylinders 118 has a check valve 122 and **122*a* at its cap end with an orifice having a diameter of about 0.040 inch, so that there is free flow of oil into the cap end of the cylinder to limit the rate at which the mobile unit can be lowered. This prevents the weight of the mobile unit 52 from forcing the oil out of the cylinders 118 faster than the pump 82 can supply oil. By providing means to control the speed of descent, the gear pump 82** can keep up.

Raising of the two outside handles of the stack valves 110 and 114, before the trunnion 80 has been raised up and locked in place, can put a very high compression load on the trunnion lift cylinders 116 and **116*a* with possible breakage or bending of parts. To eliminate this the dual relief valves 124 and 124*a* with make-up check valves 126 and 126*a* are provided in the system, identified as valve 128. The valve 128 allows the cylinders 116 to be stroked either way by permitting the oil to flow from one end of the cylinders 116 to the other when the pressure exceeds the amount for which the dual relief valve 128 has been set. The dual relief valve can be set to operate at a different pressure in each direction. When oil flows from one end of the cylinder to the other the two volumes of oil are not the same because the cylinder rods occupy part of the volume of the rod end. This dual relief valve 128 with the make-up check valves 126** accomodates this change in volume by bleeding excess oil back to the reservoir rather than to the other end of the cylinder.

The one-way check valve 130 controls the rate at which the oil flows from the rod end of each cylinder 116 and the oil free-flows into the rod ends when the oil is flowing in that direction, to control the rate at which the trunnions 80 are lowered. The pressure adjustment on the dual relief valve 128 determines the rate at which the trunnions are raised.

From the stack valve 110–112–114 the oil flows to the control valve 132 to the two quick disconnects 134, to the overcenter valve 136 and to the mast cylinder 140 which raises the mast up into its vertical position (as will be described). The valve 132 is located on the extreme front end of the mobile unit 32. The quick-disconnects 134 are necessary in order to break the hose lines from the bed of the unit 32 up to the top of the center pole; otherwise, the ride could not be turned because of the connected hoses. The overcenter valve 136 controls the rate at which the mast is raised and lowered, by pressure adjustments in each direction of flow.

The oil leaving the control valve 132 flows back to the reservoir 86 through return line filter 142 and the gate valve 144 all three of which are shared with the operating circuit. The gate valves 144 and 94 are located so that when it is necessary to change a filter element, the gate valves are closed, shutting off the oil that would otherwise run out of the reservoir when the filter elements are removed.

Once both trunnion cylinders are extended on each side of the front portion of the mobile unit and a substantial portion of the weight of the mobile unit 52 is on the landing gear, the trunnions are locked in place, as will be described, and the prime mover 60 is driven away. The pivotal kingpin plate 62 is unlocked (the means therefore to be described) and the trunnions are retracted by means of the rams 118. This causes the ride 10 to assume the position shown in FIG. 4 wherein it is resting evenly on the grade or location 58. The weight of the unit automatically causes the kingpin plate 62 to retract to a recessed flat position within a open-bottomed recess in the front of the unit 52 as the ground is reached.

The mobile unit 52, now supports almost all of the weight of the ride 10, or the weight of any other load with which the unit 52 may be used, on the forward planar portion of the bed 54. The rear off-set portion 64 has allowed the rear wheels 56 to be raised off of the grade so that, except for slight friction with the ground, they are free to rotate. The planar bottoms 64 and 148 meet at the transverse juncture 149 defining therebetween an obtuse angle, so that the bottom 148 defines an angle of about 5° with the grade 58 during transit of the unit as viewed in FIG. 2.

Figure 5:
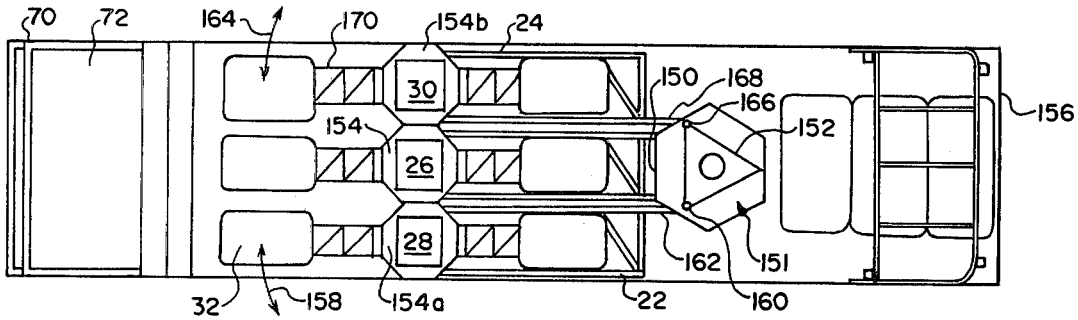
FIG. 5 is a cross-sectional view taken along lines 5—5 of FIG. 4 to show the relationship of the folded parts.

In FIG. 5 the ride has been stopped with the wall 150 of the six-sided base 51 of the mast facing to the rear along the longitudinal axis of the mobile unit 52. This view also shows the top equilateral triangular configuration of the intermediate mast part 152. The contiguous transit positions of the top platforms 154, **154*a* and 154*b* of the unit poles 26, 28 and 30 in relation to the front wall 156 of the bed 54 is also shown in FIG. 5**.

The outer or right hand unit pole sweep 22, with its unit pole 28 and associated seats 32 can be swung to and from the position shown, in the directions of the double arrow 158, about the pivot point 160 at the end of the torsion bar 162, which pivot point is carried in the mast base 151 in line with one corner of the mast portion 152.

FIG. 5 also illustrates the other outer or left hand unit pole sweep 24 with its unit pole 30 and associated top sweep 18 can be swung to and from the position shown in the directions of the double arrow 164, about the pivot point 166 at the end of the torsion bar 168, which pivot point is carried in the base 151 and is also in line with an opposite corner of the mast portion 152.

Figure 6:
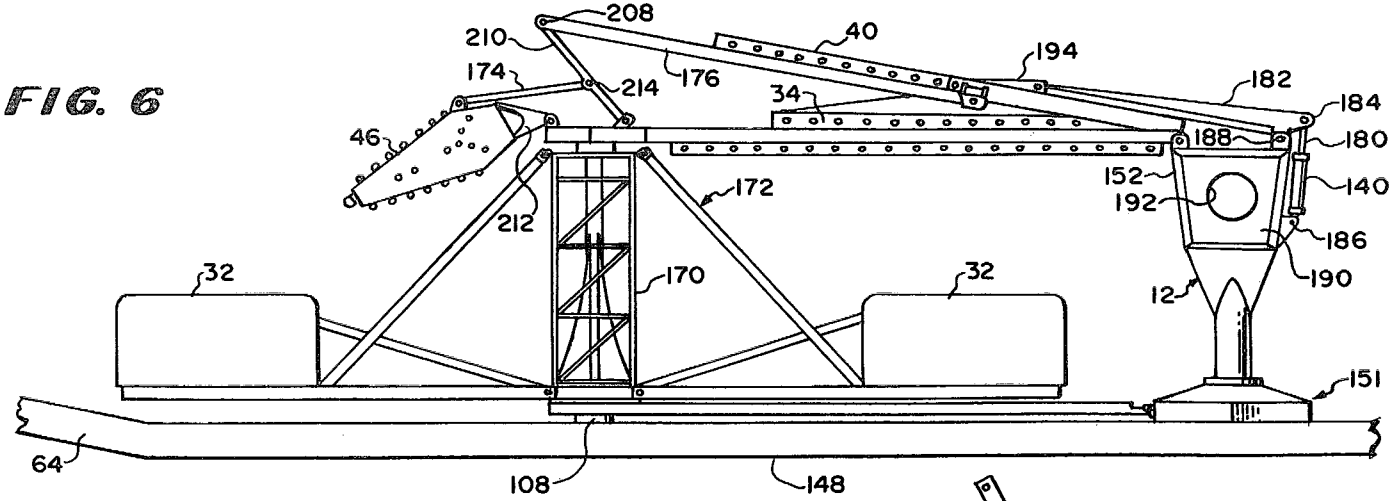
FIG. 6 is a fragmentary side view to illustrate the travel or folded relationship of the super structure or lighting system of the ride.
Figure 16:
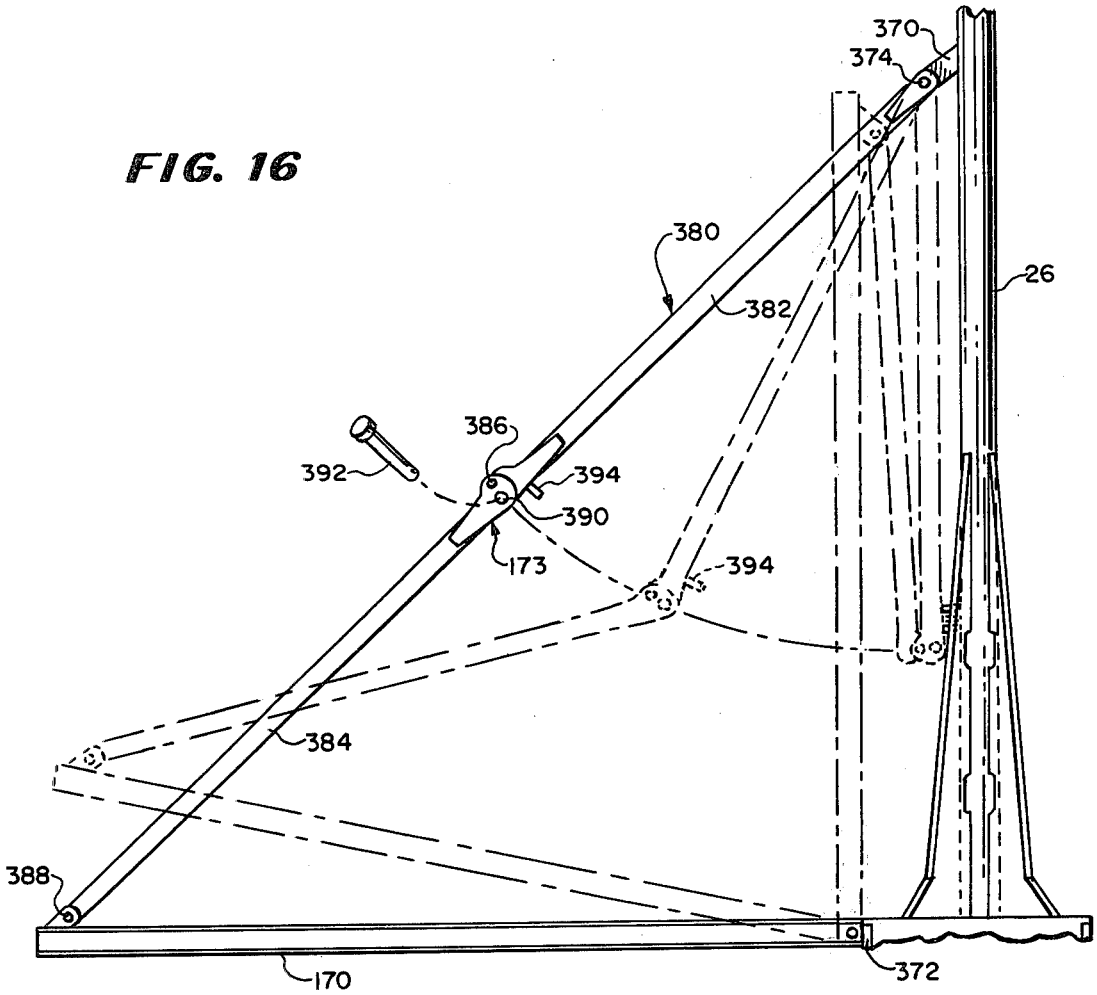
FIGS. 16 and **16*a*** show how the seat sweeps fold into travel positions and lock.

By comparing FIG. 1 and FIG. 5 with FIG. 6 it is apparent that in the folded condition of the ride each of the top sweeps 14, 16 and 18 is above its corresponding bottom sweep and diametrically opposite seat sweeps 170 provided with the linked diagonal braces 172 have been folded about their pivots 173 into positions upright against the unit mast 26, 28 and 30 and the seats from these folded sweeps have been removed and are stored at the front and rear of the mobile unit 52. All of the seat sweeps are or can be folded as shown in FIG. 16.

Each of the top unit pole sweeps 14, 16 and 18 has its associated counterbalance panel lights 46, 48 and 50, the cantilever linkages 174 and the tie rods 176 which are each pivoted to the tops of the panels 178 in down position. The six seats remain attached to their seat sweeps 170, the diagonal braces of which are foldable and linked by the central pivot 173 though not all such pivots are shown.

As viewed in FIG. 6 the three panel lights 46, 48 and 50 are in line with each other as well as the pole light assemblies 34, 36 and 38 and the linkages 174, the bifurcated tie rods and related parts.

At this time during the assembly, the stored seats can be unlocked from their transport positions and placed out of the way of all rotating parts. The seat covers can also be removed.

After any tie-downs affecting the raising of the mast and lights have been removed, the main cylinder 140 is retracted by manipulation of the valve 132. As shown in FIG. 6, the rod 180 of the cylinder 140 connects upwardly to the mast lever 182 at the end pivot 184. The cylinder 140 is pivoted to the support 186 and the lever 182 is pivoted to the top rear corner of the triangular portion 152 of the mast 12, at the pivot support 188.

This part of the mast has three equal length faces one of which is illustrated at 190 forming in cross-section an equilateral triangle. The mast 12 has a port hole 192 in each of these sides or faces, and is supported by a post from the six-sided base 151. The main hoist lever 182 is affixed to a yoke member 194 at its upper or extended end by means of a pivot pin 196, and the yoke member 194 engages the central mast panel 178 at laterally spaced pivot points 198 along its top edge.

FIG. 6 is diagramatic to the extent that it represents a side view of all three unit post assemblies and their light assemblies. Actually since the raising of the central mast panel 178 carries with it the two side panels **178*a* and 178*b*, FIG. 6 and the related FIGS. 7 and 8 will be described in relation to this center assembly. Each of the unit poles 26, 28 and 30** and its associated top sweeps 14, 16 and 18 form a rectangular configuration with the mast 12 at all times. The top sweep 14, joins the bottom edge of the panel 178 at a horizontal hinge 99 and the mast panel 178 is hinged to the mast at 200 (see FIG. 14). The mast panels 178*a* and 178*b* are carried on the vertical pivot axes 202 from the outside edges of the central mast panel 178 and the associated top sweeps 16 and 18 depend therefrom on pivot brackets (not shown) at their respective inner corners from the outer panels. Any tendency for the outer corners of the outer top sweeps to sag during transit or assembly is overcome by providing a transverse tie cable means between the central panel 178 and each side panel. Each mast panel supports a panel light 40, 42, 44, respectively, along its top edge and each has a hinged elongated tie rod 176 (see FIG. 1) that is pivoted at 204 and 206 at one end to its top edge and at 208 to the end of a counterbalance linkage 210 of the respective unit pole.

Each of the unit poles supports a counterbalancing light panel 46, 48 and 59 by means of a yoke 212 and a further connecting link 174 leading to about the midpoint of the linkage 210 at a pivot 214. The linkage 210 is pivoted at 208 to the end of the tie rods 176.

Figure 14:
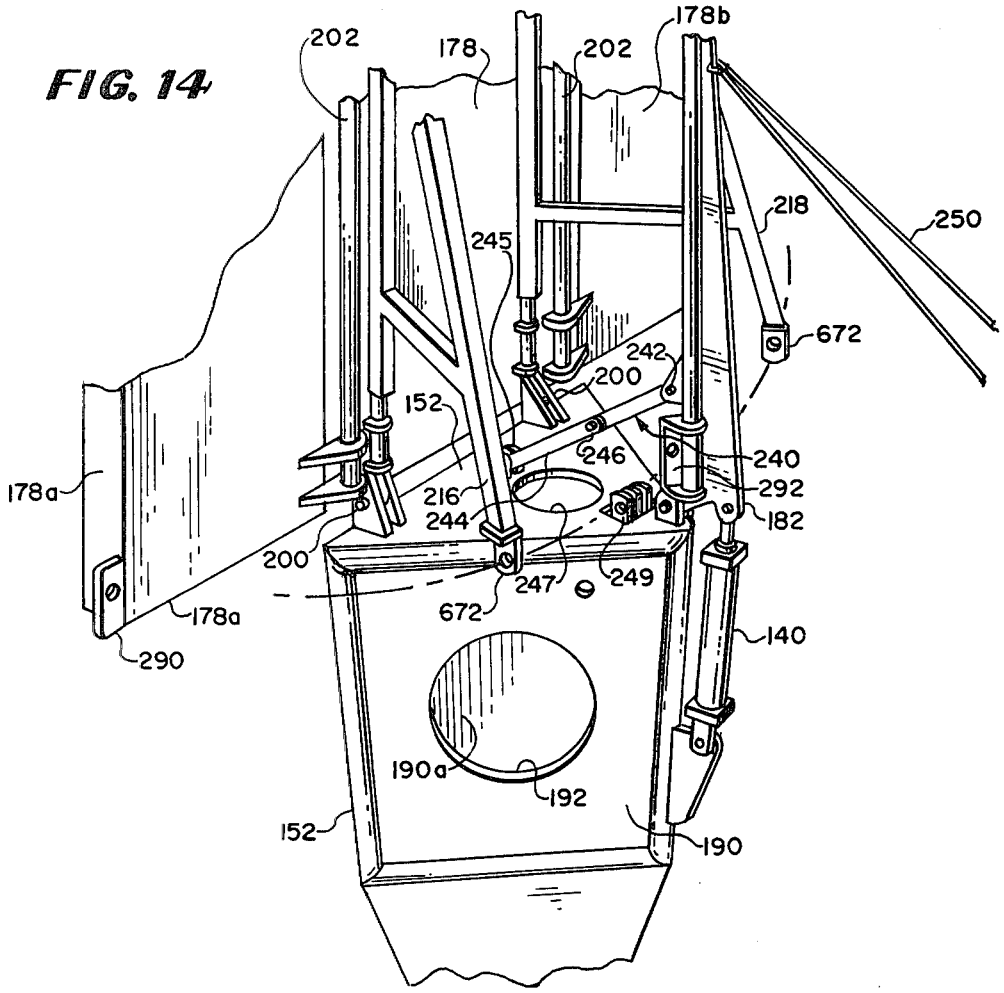
FIG. 14 is a fragmentary perspective view of the top of the mast showing how the stiff legs are anchored.

The panels 178, 178*a* and 178*b* are essentially identical except that the central panel 178 includes the pair of triangular-shaped stiff legs 216 and 218 which are at this time folded flat against the top or back side of the adjacent panels. These panels are called "barn doors" in the art and the stiff legs 216 and 218 are to be described in relation to FIG. 14. The two outer panels 178*a* and 178*b* are vertically hinged to the inner panel 178 along the pins 202 as illustrated in FIG. 14.

Figure 7:
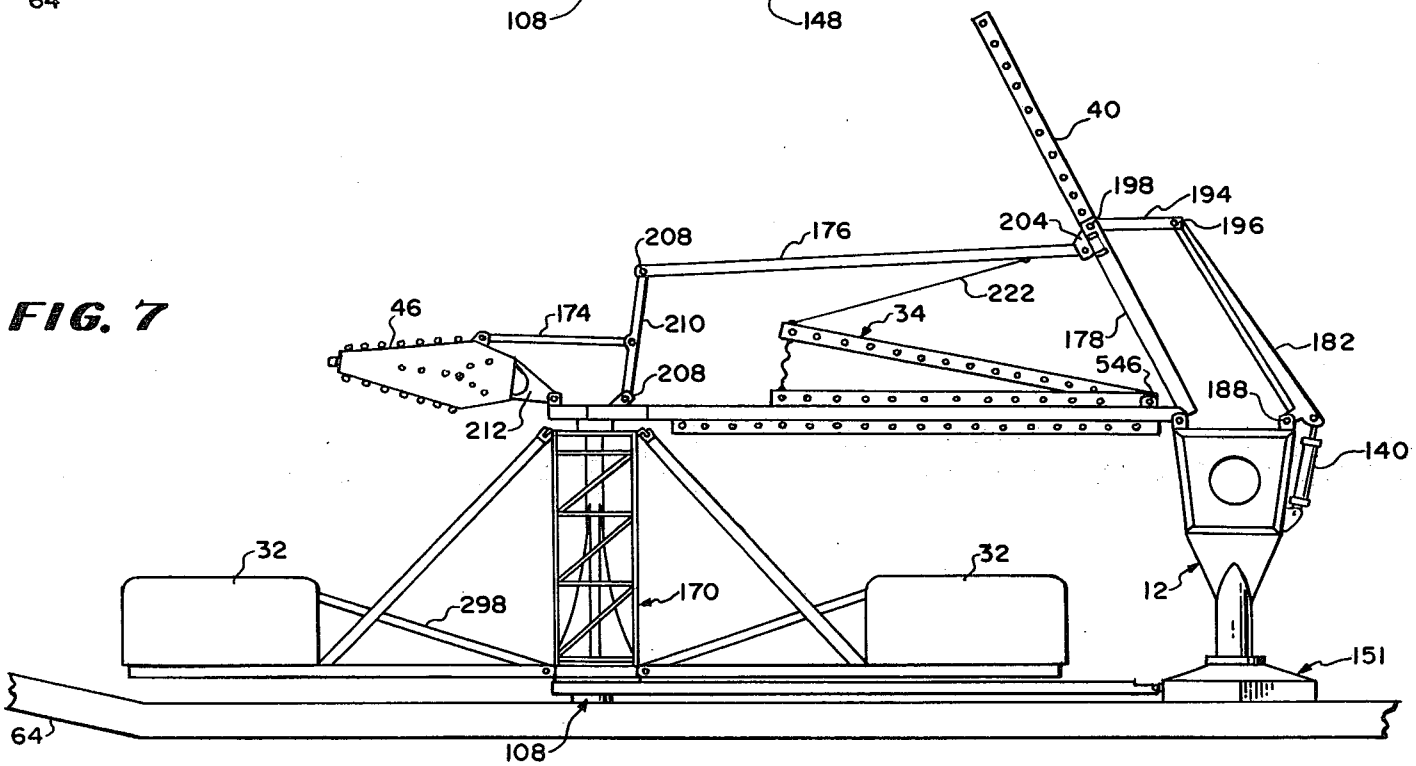
FIG. 7 is a view like FIG. 6 showing the mast lever raising the super structure.
Figures 8, 9:
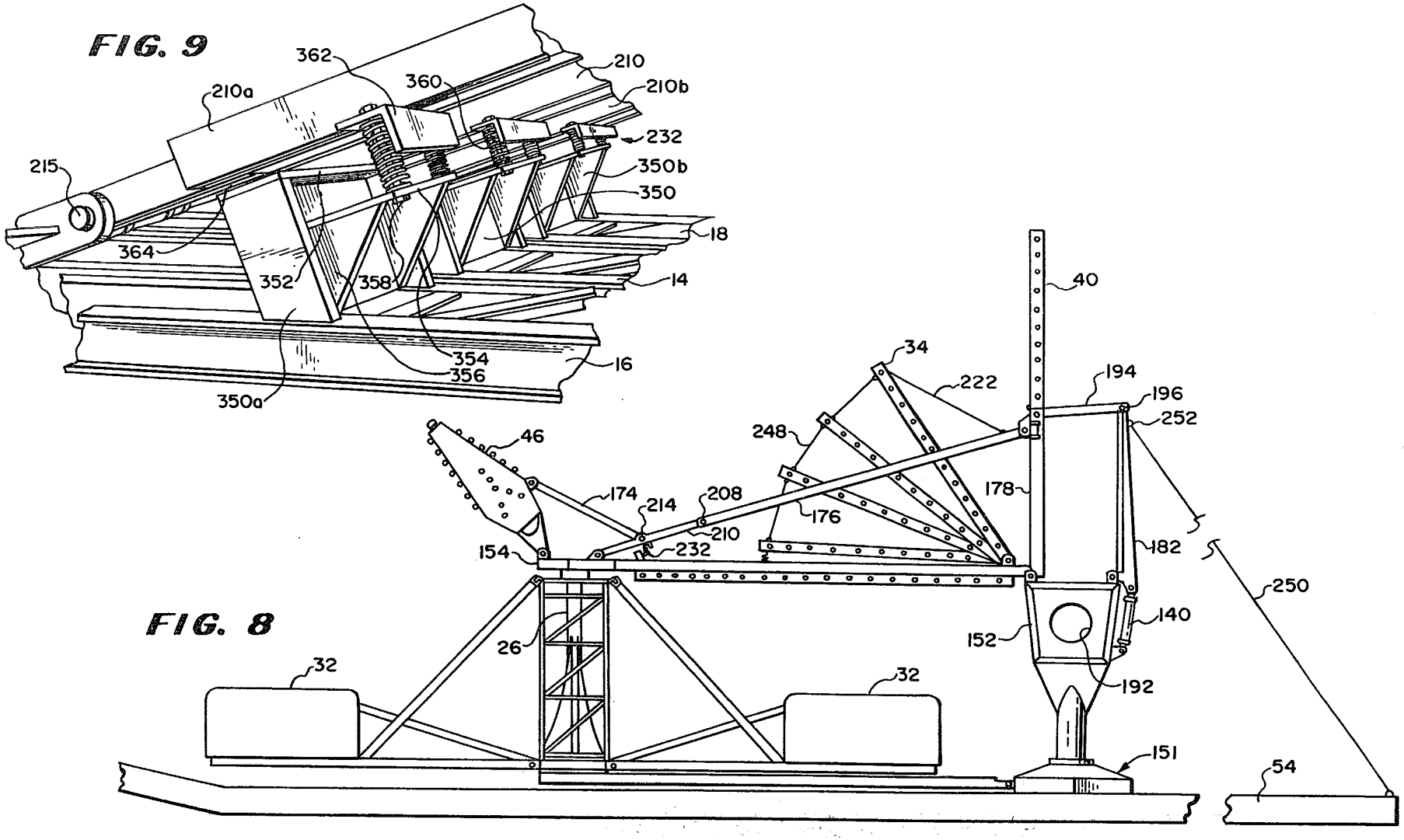
FIG. 8 is a view like FIGS. 6 and 7 showing the mast in its raised position and the other parts still folded.
FIG. 9 is a fragmentary perspective view of the resilient rest for the linkage which aids in starting the assembly to fold back to travel position.

The central panel 178 is supported horizontally by the pivots 200 along the top edge of the front face 190*a* of the mast 12 so that the three panels can hinge or pivot together, while in the same plane, from the position shown in FIG. 6, through the half-way position in FIG. 7 to the vertical position shown in FIG. 8 as the cylinder 140 is retracted. Thus it is seen that the central panel 178 carries with it the two side panels 178*a* and 178*b*.

Figures 19, 19A:
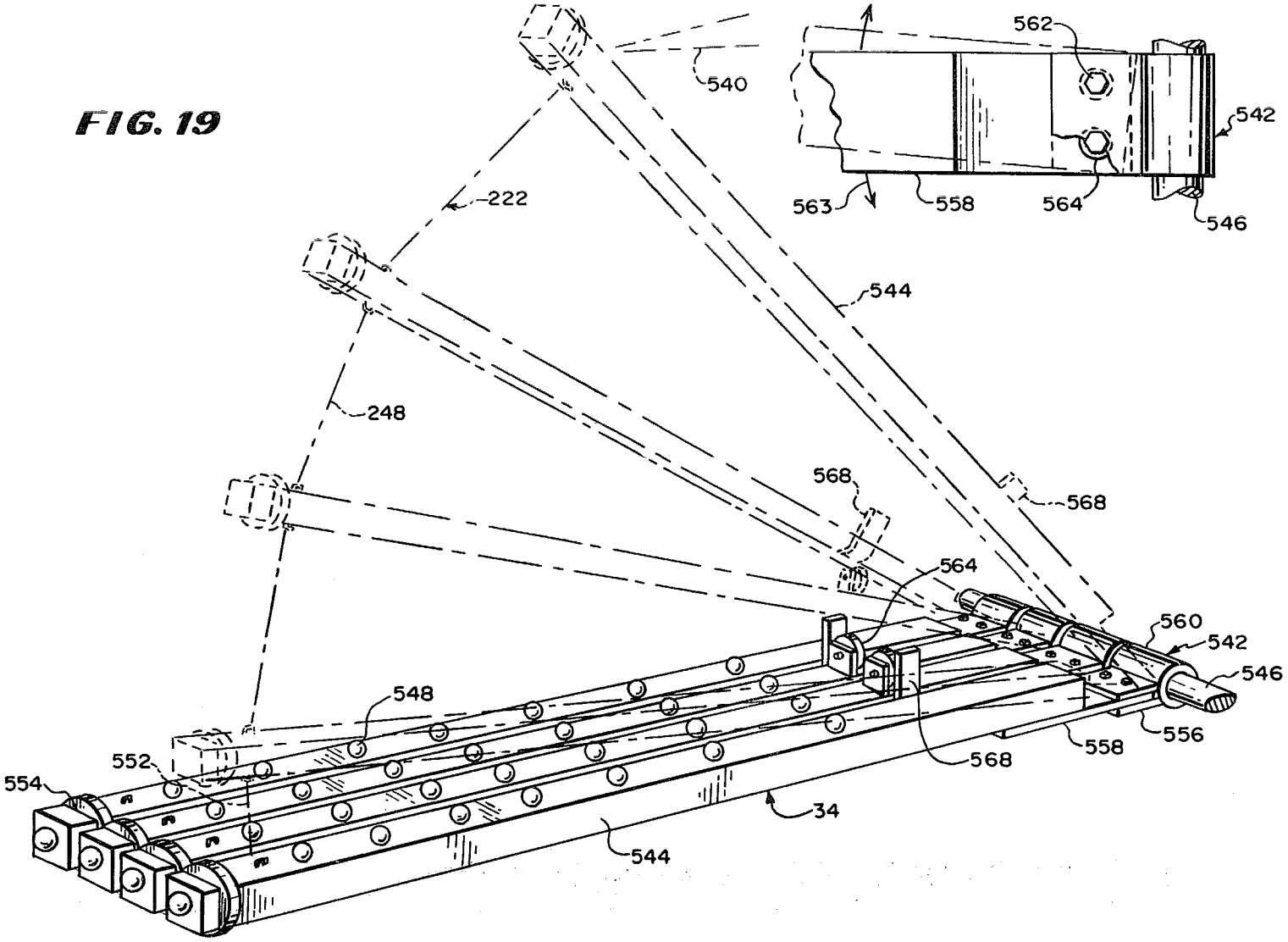
FIGS. 19 and **19*a*** are fragmentary perspective and plan views of the pole lights to illustrate their guided folding and unfolding.

The assembly includes a series of pole lights 34 connected together by the cable harness 222 and the series is gradually brought to a fan-like position as the panels 178 are raised. The pole lights are further illustrated in FIGS. 19 and 19*a* and adapted to pass between the bifurcated tie rods 176.

Understandably this light panel assembly is quite heavy and a great deal of stress may be placed upon the cylinder 140 if the steps of erecting the mast are not carefully carried out. In order to relieve some of the strain on the parts, the angular panel lights 46, 48 and 50 are provided and as shown in FIGS. 6, 7 and 8 in sequence these lights provide a counterbalancing weight so that in the start up and set down positions of the assembly the work load on the cylinder 140 is lessened.

Accordingly as the cylinder gradually retracts these parts take the position shown in FIG. 7 and finally the position shown in FIG. 8. The latter figure illustrates the primary counterbalance effect of the panel lights 46, 48 and 50 in that arrangement of linkages is about at a balance point. The panel lights very effectively raise the hinge point of the tie rods above the dead-center as the mast folds over. In order to support the assembly in this position so that the linkage point 215 is not in an exact line or at dead center with the tie rod 210 and also that the connecting linkage 210 is outside of that straight line, the spring rest means 232 is provided (see FIG. 9).

A spring rest member 232 is provided under each tie rod as further explained and described in connection with FIG. 9.

Figure 22:
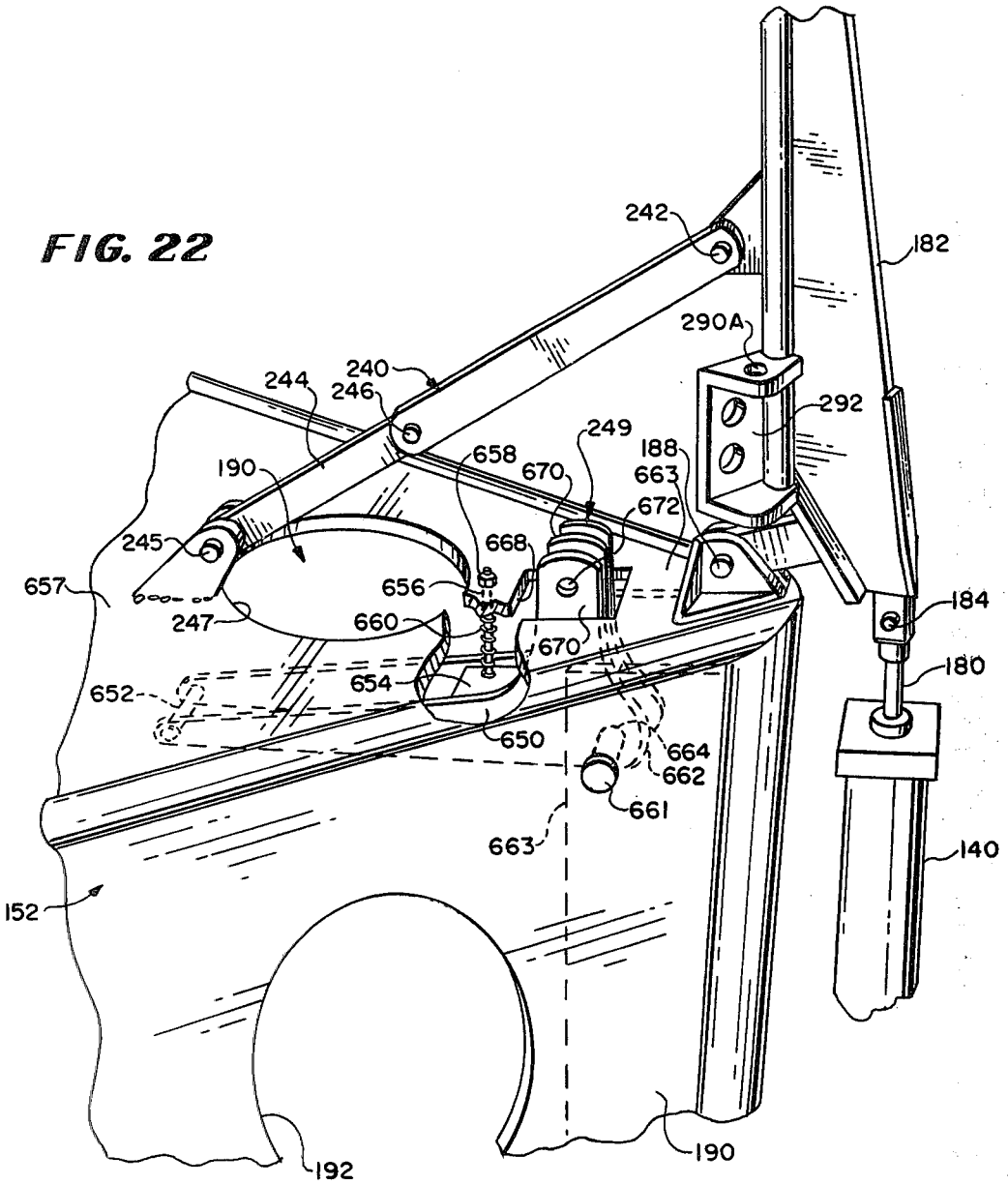

FIGS. 14 and 22 reveal the up-stop linkage 240 pivoted to the underside of the mast lever 182 at 242 and extending to the top of the mast portion 152 by means of the link 244 to another pivot point 245. This up-stop 240 has a middle pivot 246 that automatically breaks downwardly into the opening 247 when the mast is lowered. The up-stop 240 limits the clockwise pivoting of the mast lever 182 so that the panels 178 are essentially vertical in relation to the mobile unit 52 at this time. Also the cable harness 222 has pulled the pole lights to a fan-like position illustrated in FIG. 8 by means of the interconnecting cables 248.

At this stage in the assembly of the ride, the pairs of top and bottom sweep assemblies are still in the position shown in FIG. 5 and the ends most remote from the mast 12 are supported from the bed 52 by the respective travel supports 108 which engage the bottoms of the unit poles 26, 28 and 30. Before the mast is ready to take the weight of these assemblies on its one side, it must be further stiffened and for this purpose the stiff legs 216 and 218 are pivoted outwardly from the back of the panels 178*a* and 178*b* and affixed by means of a suitable anchor 249 as illustrated in FIGS. 14 and 15.

A final stiffening support is provided by the connection with the dual cable member 250 (FIGS. 8 and 14) which is attached between the top of the mast at a suitable bracket 252 and to the rear corners of the bed 54. When the cable assembly 250 has been made taut, by turn-buckles (not illustrated) the transit supports 108 are removed. After removal of any tie downs at the tops of the unit masts, the sweep assemblies are in condition to be swung individually right and left to the position shown in FIG. 1. The middle sweep assembly remains in its position shown in FIG. 10, and is the last one to be freed for rotation.

Figure 10:
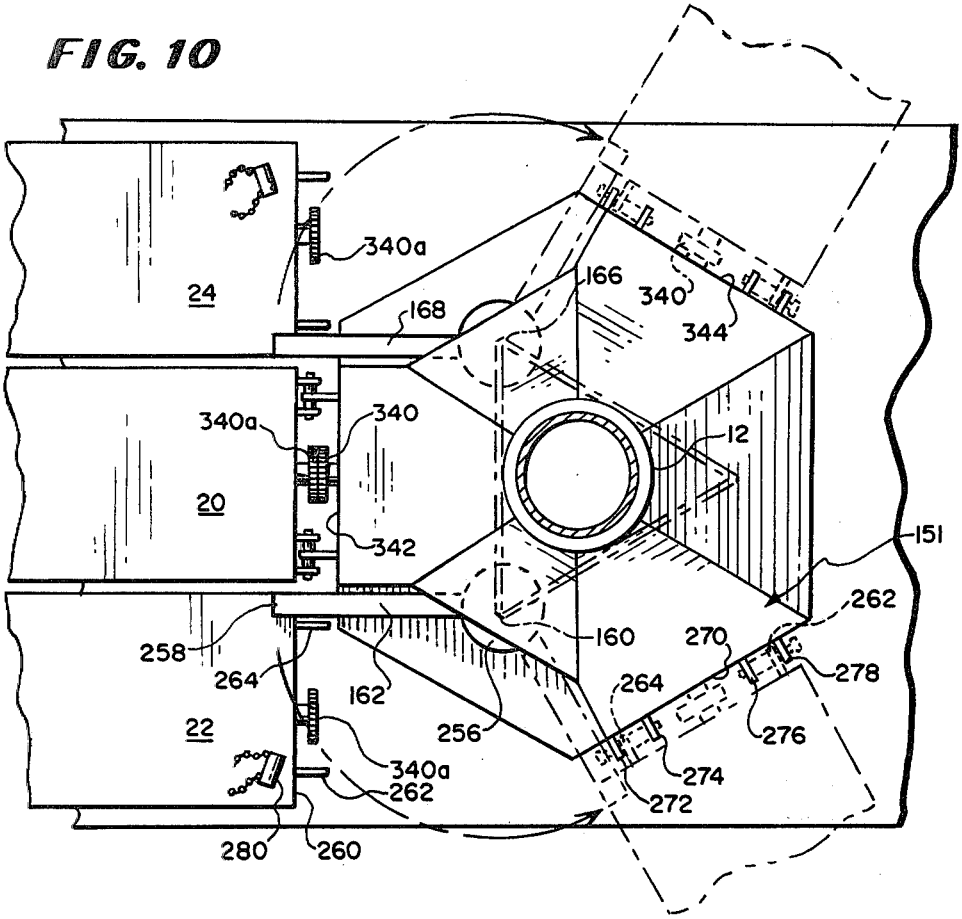
FIG. 10 is a fragmentary plan view of the base of the mast to show how the lower sweeps swing into their respective positions.
Figure 15:
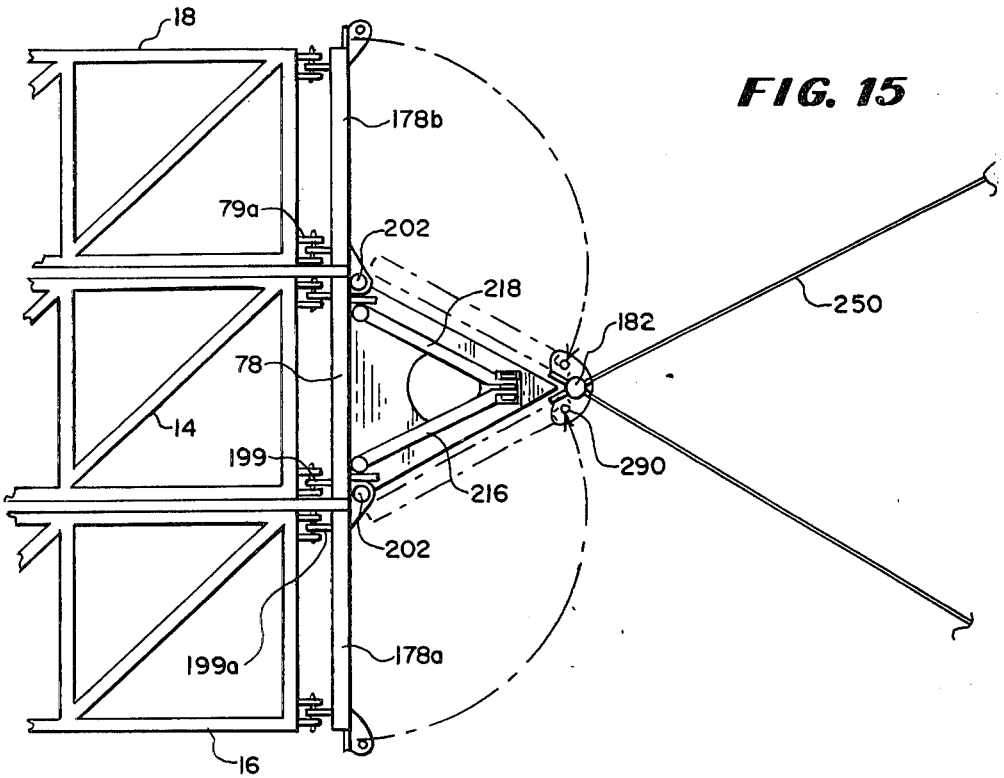
FIG. 15 is a top plan view of the mast to show how the top sweeps swing into their respective positions.

Referring to FIGS. 10 and 15, the simultaneous rotation of the right hand bottom sweep assembly 22 and the top sweep assembly 16 and followed by the simultaneous rotation of the bottom sweep assembly 24 and the top and corresponding sweep assembly 18 is illustrated. During these respective 120° rotations the weight of the individual sweep assemblies is supported on the vertical axes 202 at the top, located along the side edges of the center panel 178 while at the bottom and in line therewith the rotation is about the pivot points 160 and 166 which are defined by the base 151 (in FIG. 5). It is apparent that the vertical pivot points 202 are in a direct line with the respective base pivot points 160 and 166.

As previously stated, although the rams 104, operate simultaneously, only one of the sweep assemblies is raised thereby and freed at a time (by removal of its block support 108) and swung around to its 120° position.

With release and removal of the support 108, the right hand assembly including the top sweep 16 and the bottom sweep 22 is free to pivot as shown in FIGS. 10 and 15 to their extended radial positions shown in dotted lines (in FIG. 10). In order to support the bottom sweep 20 from the base and provide this pivot action the torsion bar 162 is provided. This torsion bar is pivotally mounted from the base 151 through the circular housing 256 and is rigidly affixed to the bottom sweep at its end 258. The inside end 260 of the bottom sweep 22 is provided with a pair of tabs 262 and 264 which are spaced from each other and from the side edges of the sweep and are suitably bored to receive a connection pin. The side 270 of the base 151 to which the sweep 22 will swing is provided with a first pair of tabs 272 and 274. As the lower sweep 22 pivots about the axis 160 from the full line position shown in FIG. 10 to the dotted line position, the tab 264 will come between the tabs 272 and 274 and the respective bore holes will be aligned to receiver a hinge pin.

Figure 11:
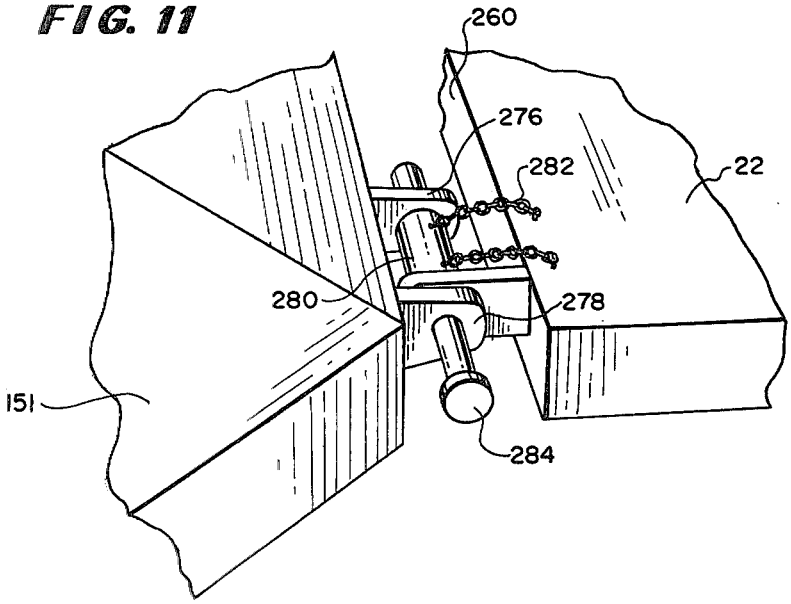
FIG. 11 is a fragmentary perspective view of the attachment means for one corner of a bottom sweep.

The side 270 is provided with a second pair of bored tabs 276 and 278 at its other end, to receive the single tab 262. The moving parts are heavy and the pins not easy to place, and lock the assembly. However, this is facilitated by providing on the bottom sweep 22 the short piece of tubular metal or pipe 280 which is held thereto by means of the pieces of chain 282 welded to the sweep 22 so that is will not be lost. The pin 284 (FIG. 11) is placed through the tabs and the tube 280, the latter acting as a spacer and preventing side play after assembly.

If necessary a stop member can be provided so that as the bottom sweep swings into position, the respective bore holes in the tabs are in alignment. The greater space between the tabs 272 and 274 can also be taken up by dropping a tubular member 280 in line with the bore holes and placing the pin therethrough. The center bottom sweep 20 is similarly attached by tabs and pins as shown, and since this bottom sweep does not change in position further description is unnecessary.

The top sweep (FIG. 15) corresponding to the bottom 22 also pivots therewith around the vertical axis or pin 202 as previously described and to the dotted line position shown where it is also pinned in place by large pins (called elephant pins) that are driven through suitable tabs to a locking position. Suitable means to so lock the panel 178*a* to the mast are illustrated at 290 and 292 in FIG. 14. The top fastening means are not illustrated.

Short tie cables can be used to snug the outer assemblies of sweeps into their 120° positions in relation to the mast. Any parts that don't go to their pinning position can be brought into position by these means or by means of "elephant pins". Such pins are well known in the art and have a pair of spaced flanges housing a sliding hammer that encompasses the shank therebetween. The holes 290*a* receive pins or studs in fastening.

The mast lever 182 becomes the front part for the assembly and the panels 178*a* and 178*b* each in turn are pinned to the mast 182 as the tabs 290 and 292 in the mast and on the inside edges of the panels come or are brought together. An elephant pin, with its built-in sliding hammer, is useful for this purpose since the parts are close together and it is difficult to use a hammer. At times a bolt is used to engage between the tops of the panels 178*a* and 178*b* to bring them together for pinning by a regular pin.

After checking all parts, making sure the stiff legs 216 and 218 are locked to the anchor 249 the center pole bracing cables 250 are removed. The transit supports 108 have all been removed including the transit support under the unit post 26, associated with the bottom sweep 20, and are lowered to their flush positions. The folded seats sweep are unfolded for each of the unit poles and the stored seats are attached. Generally it is easier if the top sweeps are pinned to the mast before the bottom sweep are pinned to the base.

The seat tie rods 298 are installed as well as the steps etc. Also the quick disconnect 134 is disconnected for the cylinder 140 and all hydraulic hoses stored out of the way.

After connecting the ride to a suitable source of electric power i.e. 120 volt a.c. the single control comprising a brake ratchet handle 299 on the platform 72 is moved to its rear or brake position putting the hydrostatiic transmission in neutral. A microswitch is used to prevent starting the motor until the hydrostatic transmission is in the neutral position. This microswitch prevents the pushbutton starter on the magnetic controller from being energized.

Referring to FIG. 13 the hydrostatic transmission 92 contains a variable volume pump 300 which supplies hydraulic pressure and flow through the hydraulic motor 302 in a closed loop. The hydraulic oil is drawn from the reservoir 304 through the sump-strainer 306 and via the gate valve 308 through the suction filter 310. A one-way valve 312 is provided to allow the hydraulic motor 302 to free wheel so that the inertia of the ride wanting to continue to turn allows the fluid to short circuit through the check valve 312 instead of returning to the hydrostatic transmission 92 and driving it.

A needle valve 316 is provided in the circuit which when opened allows free flow of oil in both directions so that the ride center pole 12 can be turned in either direction by hand. The relief valve 318 limits the rate of acceleration of the ride by limiting the driving pressure coming from the hydrostatic transmission 92 to the hydraulic motor 302. Excess oil pressue is fed off into the return line of the closed loop.

A gauge port 320 on the relief valve 318 allows the installation of a gauge for checking the line pressure in the driving circuit. A high pressure filter 322 filters the hydraulic fluid returning from the hydraulic motor 302 to the hydrostatic transmission 92. The case drain from the hydrostatic transmission 92 flows through the return line filter 324 through the gate valve 326 back to the reservoir 304. The electric motor 328 is provided to drive the hydrostatic transmission 92 through the coupling 330.

The drive motor 302 is located in the housing or base 151. A pinion and ring gear drive combination is used between the hydraulic motor and the rotating mast 12.

Referring to FIG. 10 additional driven parts are illustrated by the driven gears 340 which extend from suitable shafts on the side 342 facing the bottom sweep 20, the side 270 facing the bottom sweep 22, and the side 344 facing the bottom sweep 24. As these sweeps are brought together and pinned the respective gears 340 come into alignment with the gears 340*a* on each of the sweeps. With the gears in juxtaposition, a short length of roller chain is placed circumferentially around the gears and properly pinned to complete the coupling. This kind of drive coupling is well known in this art and does not constitute a part of this invention. Each gear 340*a* has a driven shaft connected to a pinion gear drive that rotates its associated unit pole and carries the seats in a circular path. The drive means arrangement also rotates the main mast 12 and the ride is in full operation and ready to receive passengers.

In the foregoing description certain parts or means were described generally without specific reference to an illustrative structure, these include the tie rod down stop 232 (FIG. 9), the folding seat sweeps 170 (FIG. 16 and 16*a*), the landing gear assemblies 80 (FIG. 17 and 17*a*) the pivotal kingpin plate 62 (FIG. 18 and 18*a*), the fan light assemblies 34 (FIGS. 19 and 19*a*) the bottom sweep supports 108 (FIGS. 20–21) and the stiff leg anchor 249 (FIG. 22).

These means are now described though not necessarily in order of their use during unfolding or folding the ride.

Means to stop and hold the top tie rods 176 in a ready position so that the pivots 215 are above dead center and do not bind when the cylinder 140 is extended to re-fold the top light assemblies of the ride are illustrated in FIG. 9. The frame of each top sweep 16, 14 and 18, as viewed in their folded positions, each carry a bracket 350 bearing the same letter designations as the tie rods, each bearing a top plate 352 which is centered so as to substantially parallel to and spaced from the under sides of each link 210 at a position adjacent to the pivots 208 and as shown in FIG. 8 at about the point of attachment (pivot 214) of the links 174.

The stop plates 352 may represent the lower limits to which the links 210 can yield before going past dead center on the pivots 215.

Each bracket 352 has a shelf 354 held in a plane substantially parallel to but below the top plates 352. The shelf plates 354 support a pair of spaced bolts 358 encompassed by the compression springs 360 and retaining an angle iron shoe 362 at the top. The heads of the bolts 358 are spaced each side of the bottoms of the links 210. The bolts 358 are adjustable along their longitudinal axes so as to vary and control the stop and biased position of the links 210, thereby defining the space 364 between the shoes 362 and the bottoms of these links.

A balance is thus defined between the counter balance weights, represented by the light panels 46, 48 and 50 and the inertia of the assemblies 34, 40, 178 etc. on the other side of the pivots 215. This balance thus favors the upward break of the pivots 215 and the down sweep of the lights 46, 48 and 50, at least sufficiently to over come the friction of the parts. Other means to accomplish these results can be used such as hard rubber cushions and leaf springs.

Figure 16A:
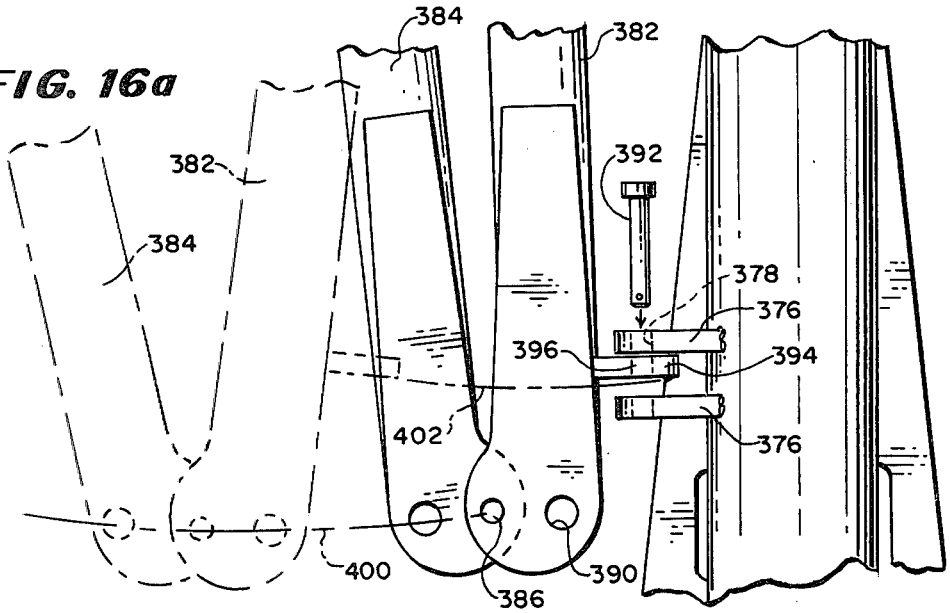

In FIGS. 16 and 16*a* a modified form of foldable seat sweep 170 is shown which is characterized by the ease with which it folds and unfolds as well as the unique inward travel path of the lockable pivot in its supporting linkage. This makes it possible to provide a lock for the folded position that engages easily without binding and just as easily unfolds.

The unit pole 26 has the upper bracket 370 on one side which is closer thereto than the bottom bracket and pivot 372. In between and almost directly under the pivot 374 of the bracket 370 the pole 26 supports a pair of tabs 376, having vertically aligned boreholes 378.

The seat sweep 170 is supported in its extended radial postion by the diagonal linkage 380 comprising the top link 382 and the bottom link 384 connected at about the mid-point at the central pivot 386 of the diagonal distance between the pivot point 374 and the bottom pivot 388 with at the extended end of the seat swings 170. The pivot 386 has alignable bore holes 390 to receive the locking pin 392 and thus stiffen the diagonal brace 380 in its extended position.

With the pin 392 removed the pivot 386 allows the brace 380 to break, as the seat end of the sweep is raised, and assume the various dotted line positions as shown. At or above the pivot 386 there is provided the locking lug 394 having a bore hole 396 registerable with the bore holes 378 in the tabs 376, in order to receive the pin 392 or a similar pin to lock the assembly in compact upright position.

Referring to FIG. 16*a* it is seen that the arc 400 followed by the pivot 386 is not the same as the arc 402 followed by the lug member 394 and because the links fold to a nearly vertical position under the pivot 374 the last few inches of travel of the lug 396 is essentially planar and directly into the space between the tabs 376 so that a secure locking arrangement, free of looseness is obtained.

Figure 17:
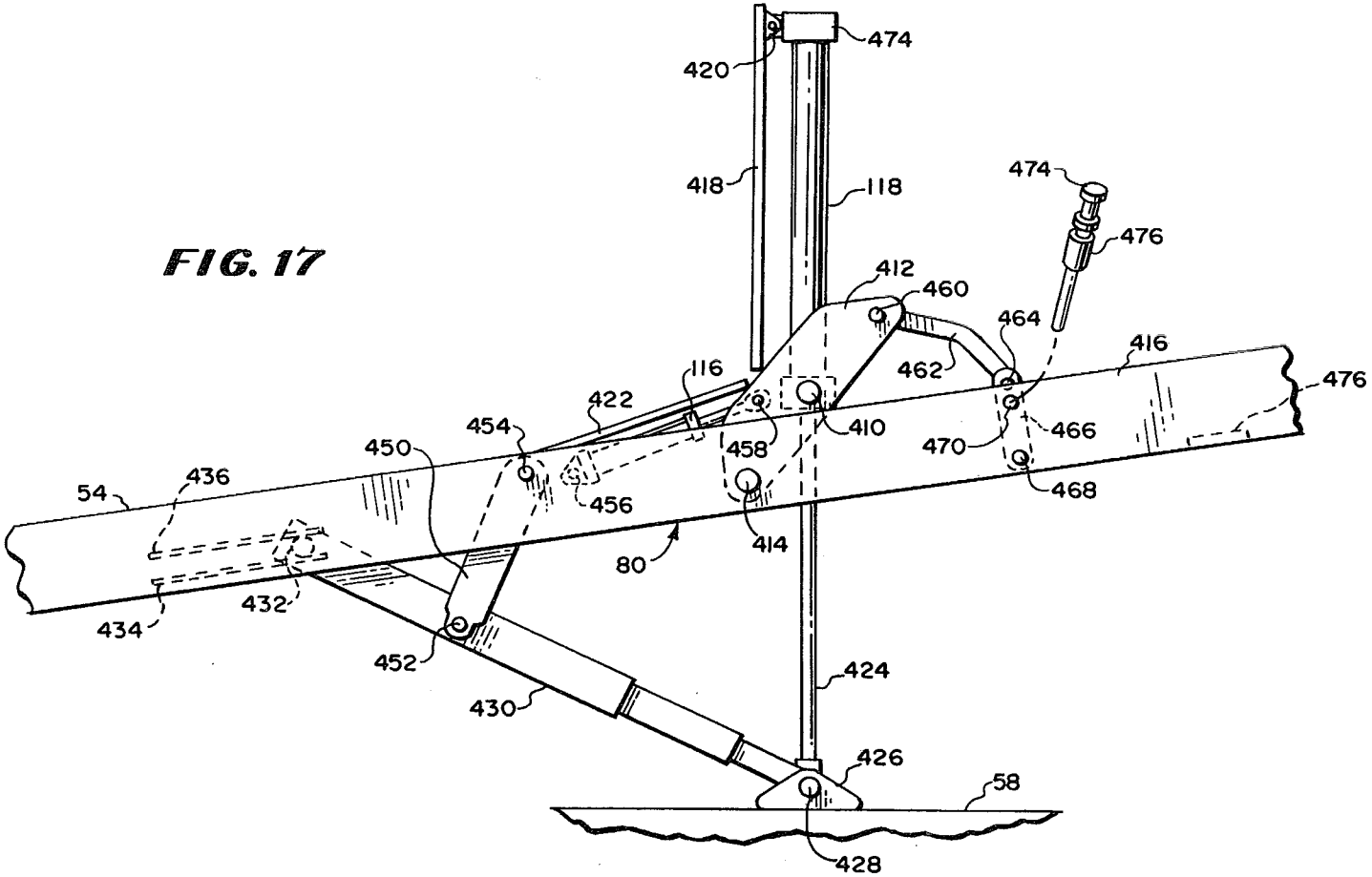
FIGS. 17 and **17*a*** are fragmentary plan views to show the relationship of the parts of the landing gear in folded and unfolded positions.
Figure 17A:
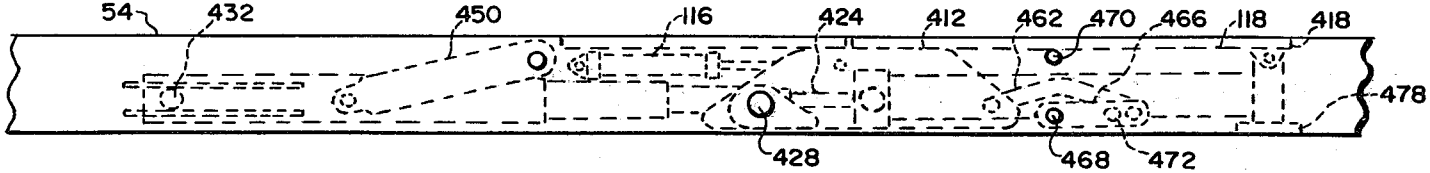
Figure 18:
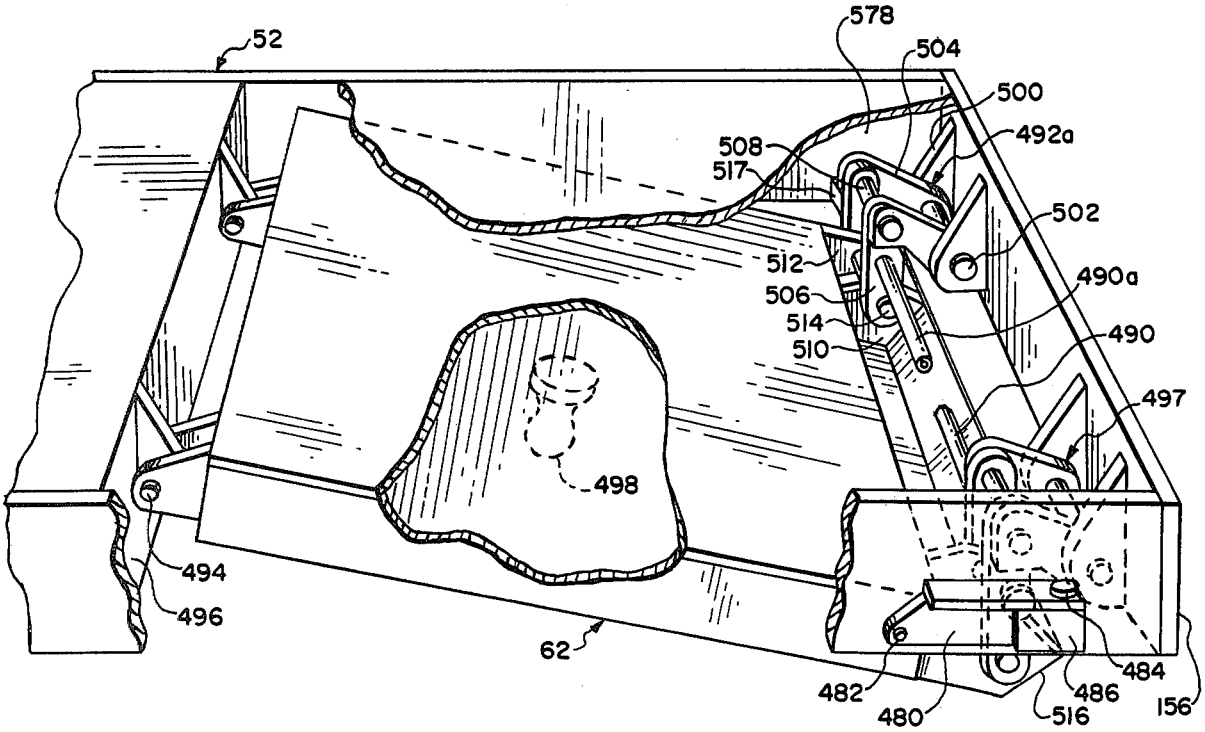
FIGS. 18 and **18*a*** are fragmentary perspective views to show the relationship of the parts of the retractable kingpin plate.

The landing gear assembly FIGS. 17 and 17*a* also contain some geometric relationships which are unique to this art in that repeated operation of the landing gear 80 at the same location and without blocking the trailing wheels 56, produces no tending to "walk" or pull the mobile unit 52 along in either direction. This assembly is mounted within a recess in the side beam of the mobile unit 52 so that as shown in FIG. 17*a* upon retraction it folds flush with the bed 54. There are two assemblies 80 one on each side of the mobile unit 54, each being located at the front end and just behind the kingpin plate 62 (see FIG. 3). The main cylinder 118 is pivotally mounted on the axis 410 between the trunnions 412 only one of which is shown. The trunnions 412 are pivoted at 414 to the pair of spaced side frames or girders 416 defining the recess into which the landing gear folds.

The cylinder 118 carries a plate 418 by means of a suitable bracket 420 which is long enough and wide enough to cover the opening of the recess when the assembly is folded. A second plate 422 rides in the spaced trunnions and closes the remaining part of this top opening.

The cylinder 118 has its piston rod 424 in the extended position with the shoe 426 which is pivoted there at the pivot 428, on the grade 58. The primary link 430 is also pivoted from the pivot 428. The other end of the primary link extends into an open bottom recess between the girders 416 where it carries a pair of guide rollers 432, one on each side, and which guide rollers are engaged for rolling contact fore and aft by the parallel spaced quides 434 and 436.

The primary link 430 is pivotally attached intermediate its ends to the secondary linkage 450 at the axis 452 and its other end extends into the recess and is pivoted therein at the pivot 454. The secondary link 450 is double or bifurcated and the two parts are adapted to pivot to positions on each side of the main linkage 430 as shown in FIG. 17*a*.

The smaller operating cylinder 116 for the landing gear assemblies 80 are each pivoted in the recess at one end as by the pin 456 with their piston rods engaging the pair of trunnions 412 at the pivot 458.

The front end of the trunnions is linked at 460 to a pair of locking links 462 (one on each side) which in turn are linked at 464 to a second pair of spaced locking links 466, in turn pivotally mounted at pivot 468 within the recess. Both the link 466 and the sides of the beams 416 have a bore hole, indicated at 470 for the latter and at 472 for the former. When the ram or cylinder 116 has raised the cylinder 118 to the extent of its travel whereby the ram 118 is close to being perpendicular to the plane of the bed 54, the holes 470 and 472 come into registery to receive the trunnion pin 474 having a pair of spaced flanges between the sliding hammer 476 reciprocates. The hammer can have an arcuate handle to facilitate its use.

Comparing FIG. 17 and 17*a* more closely it is seen than in the folded condition the pivot 428 aligns itself with and comes between the main pivot 414. The secondary linkage causes the main link 430 to move to the rear as the cylinder 118 extends and retracts. This action prevents the shoe 426 from having a tendency to move the mobile unit 52 as the main cylinder 118 extends or retracts.

In order to fold up the landing gear the pin 474 is first removed from the bore holes 470 and 472, the cylinder 118 is then fully retracted. The mobile unit 52 now rests on the grade 58. The cylinder 116 is now extended and the cylinder 118 is pivoted by the pivot 410 around the pivot 428 until its head end 474 comes to rest on the resilient pad 478 within the recess.

The landing gear 80 serve the purpose of taking the weight of the front end of the mobile unit of the kingpin plate 62 so that the prime mover can be driven away. This leaves the king pin plate in its "locked down" position shown in FIG. 18. In order to release the king pin plate so that it can pivot upwardly on striking the ground, as the cylinders 118 and 118*a* are retracted, the latch or pin guard 480 is released for pivoting to the open position about its pivot 482 by removing the thumb pin 484 from its bracket 486. This exposes the long pins 490 and 490*a* (one on each side of the mobile unit for removal.

Figure 18A:
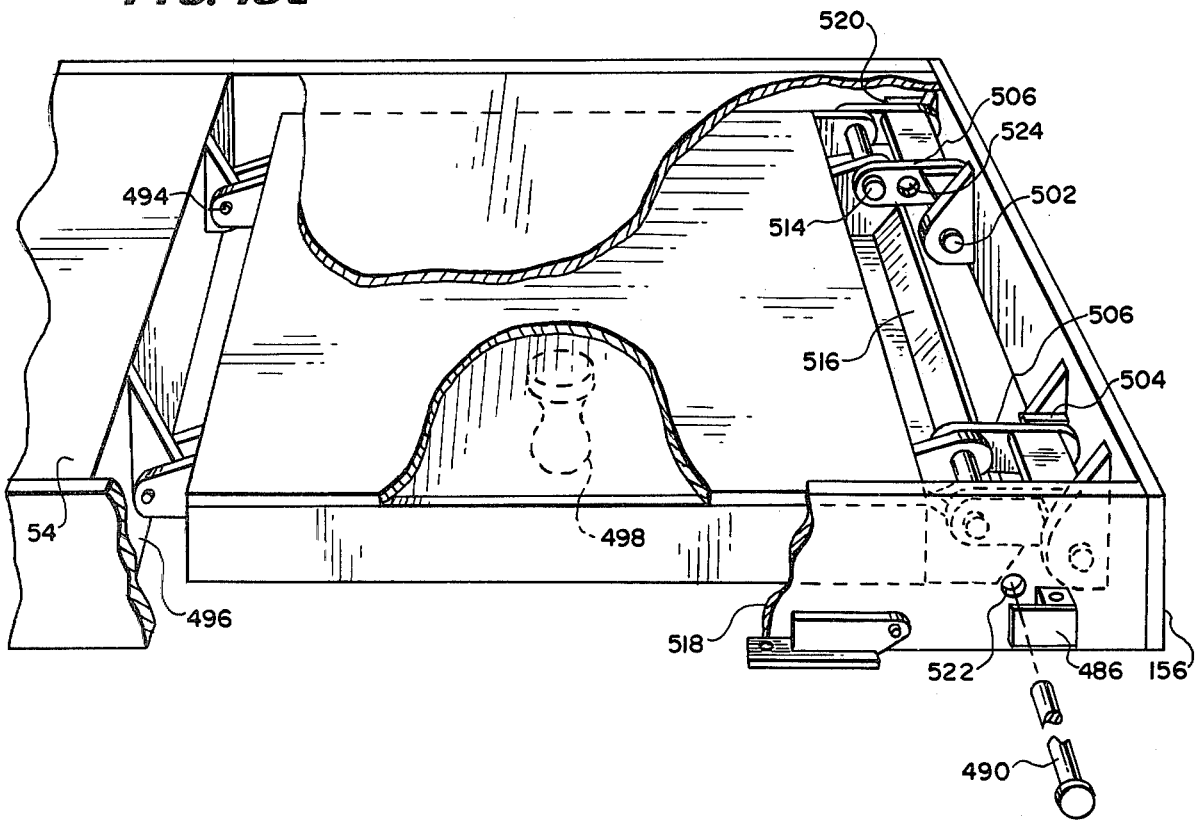

With the pins 490 out, the front pivot-linkage assemblies 492 are unlocked and the kingpin plate 62 is free to pivot about its rear pivot pins 494 into the front recess 496 as shown in FIG. 18*a*. The kingpin proper, shown at 498 protrudes below the plate but not necessarily below the bottom of the bed 54. Depending on conditions steps should be taken to protect it from dirt or damage as it may come into contact with the grade.

The pivot-linkage assembies 492 are indentical and formed of parts that can carry the load of the front end of the unit 52 in a manner to meet all safety standards. Each assembly 492 has a pair of cleats 500, carrying the pivot 502 from the inside of the front wall 156. To this pivot the double link 504 is mounted for rearward extension to the connecting linkage 506 at the pivot 508. The connecting linkage 506 is in turn connected to the cleat 510 and the side wall 512 of the king pin plate 62 at the lower pivot 514. The front edge 516 of the plate 62 is beveled to facilitate passage over and upon a 5th wheel.

A block or stop member 516 is welded to the side wall 518 against which an offset 520 on the out side linkage 504 engages to arrest the down ward pivoting of the assemblies. At this point the bore hole 522 in each side wall 518 comes into axial alignment with the pair of aligned holes 524 in the double link 506 so that the long pins 490 and 490*a* can be driven in from both sides and lock the assembly into its down or mobile position. Only one stop member 516 has been shown it being understood that the same structure is provided for both assemblies 492. In the raised position, the linkage 506 goes from a vertical position to a horizontal position and the holes 524 no longer are aligned with the holes 522.

As before stated the poles light assemblies 34 (See FIG. 19). are each adapted to pass between the legs of the bifurcated tie rods 176. This bifurcated structure with the pole lights therebetween can be seen in FIG. 1. Partial balance to the pole light assemblies 34 is provided by the dual top cables 540 of the harness 222 while the ability to unfold and assume a relatively coplanar relationship is provided by the hinge members 542 at the base of each pole 544 and having a common pivot 546. These poles 544 are elongated and extend side-by-side from their respective hinges along the top sweeps 14, 16 and 18 where they rest in travel positions. The lights therefore are illustrated at 548.

The poles 544 are tied in any desired sequence one to the other by the single strand 248 and the lowermost pole is tied to the sweeps by a short tether 552 which can be resilient e.g. comprise a compression spring shock absorber. One arrangement is to have one of the inner poles tethered with the strand connected from that pole to the other inner pole which latter is connected to the adjacent outer pole and finally the connection goes to the remaining outer pole. More or less than four poles 544 can be used to create the array of fan-like lights.

The extended ends of the poles are provided with the circular plastic or hard rubber spacers 554 which contact each other at their outer surfaces in the fold-down position. At the other ends the hinge members 542 are provided with the clamp member 556 engaging on both sides of the plate 558. The clamp member has a tubular section 560 which rotates around the long pin 546. The brackets holding the pin 546 in place on the top sweeps are not illustrated. The hinge is held together by a pair of bolts 562 one of which passes through a hole 564 in the plate 558 that is larger in diameter than the bolt. Both bolts are snugged down and remain in place, but are not tight enough to bind the assembly. Therefore the plate 558 can oscillate or pivot slightly along the pivot axis 562 as indicated by the arrow 563 in FIGS. 19*a*.

Means are provided to further guide the poles 544 from their coplanar fan-like position shown in the broken lines to the folded position, in the form of the roller 564 supported on the tops by cleats (not shown in the drawings) extending from the top sides of the inner pair of poles and the guide plates 568 carried on the inside walls of the outer cleats in the series. It is apparent that as the inner poles (if so connected by the strand 248) come to rest the rollers 564 can engage one upon the other and place one pole beside the other, as the circular guides 554 do the same. Next, one of the outer guides 568 will strike a roller and divert the next pole to its place on the outside of the array. Lastly the final pole will be guided to position by its guide plate. The guide plates 568 are identical for each pole but mounted in reverse of the other.

Figure 20:
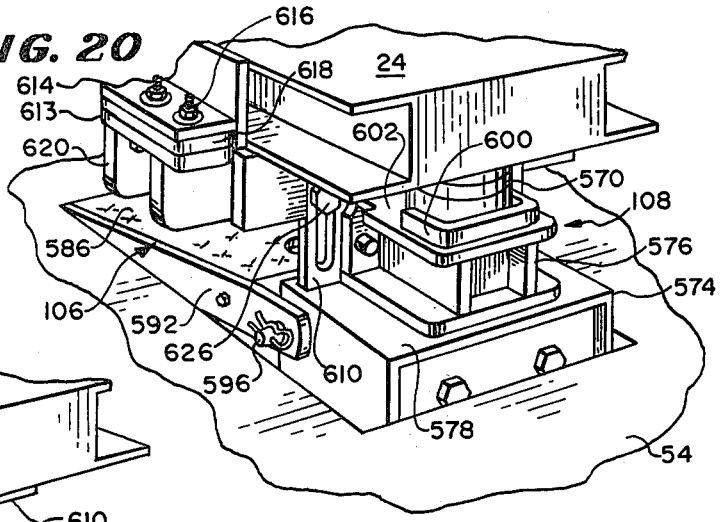
FIGS. 20 to **20*b* are fragmentary perspective views of the traveling block and its cooperating lifting cylinder 104**.

FIG. 20 shows one form of transport block assembly 108 as the means to hold the weight of the sweep and seat assemblies during transport. The assembly 108 is shown taking the weight of a bottom sweep, e.g. 24 as received from the left hand side of the ride looking toward the front. This end of the sweep is provided with a snubber or cup 570 that protrudes downwardly at the end for engagement with a ram or cylinder 104, the piston rod 572 of which is shown (FIG. 20*a*) in its extended and temporary load-carrying position thereagainst.

The cup 570 may have a depression or pocket in its bottom end to receive the end of the piston rod 572 so that it cannot accidently disengage. In FIG. 20 the piston rod 572 is retracted into the box member 574 and the block member 576 has taken its place. The block member 576 rests on the top side 578 of the box member 574 with the slotted opening 580 vertically aligned over the rod 572 and with the chamfered surface 582 (FIG. 20*b*) directed to receive the cup 570, a rubber coating or other tough resilient surface can be provided on the cup 570 as a partial cushion and shock absorber.

The box member 574 provides a pivotable housing for the cylinder 104 and it is held during transport within the recess 584 in the deck 54 by means of the cover plate assembly 106 including the first plate 586. The cover member 106 is hinged at the pivot 590 across the front end of the recess 584 and has the pair of side cleats 592 having the bore holes 594 that are engaged by the long pin 596 extending therethrough when the cover is in a partially raised position and the cleats are on each side of the box member 574. A click pin 598 holds the long pin 596 in position yet makes it readily removable.

The block member 576 may be provided with an arcuate stop or guide wall 600 (not shown in FIG. 20*b*) on its top surface 602 to aid in its placement into the position shown in FIG. 20. The block member 576 has the cut out corner 604 in the front face 606 and top 602. The front face 606 carries a pair of protruding steel dowel rods 608 that are spaced inside the corners 604 and lie in a plane transverse the block 576.

The box member 574 has a tie plate 610 that is oriented vertically across the front end of the top 578. The tie plate 610 has a pair of bore holes 612 so spaced to receive the dowel pins 608 with the face 606 against the plate and the snubber 570 nested in the U-shaped guide 600 and the chamfer 582.

The tie plate 610 is supported in a transverse slot in the top 578 of the box member 574. It may be bolted in this slot for partial vertical reciprocation is desired.

Each bottom sweep has a bracket 612 which extends transverse the end, held thereto by an angle iron 614, accommodating the bolts 616. One or more resilient spacers 618 can be mounted between the bracket and the cleat. The same type of mounting is used at the other side of the bottom sweeps 24 and the other sweeps.

The bracket 612 includes a pair of elongated vertical cleats 620 that extend in vertical parallel relationship under and from the bracket 612 across the end of the sweep 24. The outermost of the cleats 620 carries a stop member 622. Both cleats are spaced and have aligned bore holes, one in the outermost plate being illustrated at 624. These bore holes align with the slots 614 in the tie plate 610 when the stop member 622 strikes the edge of the plate 610. The cleats 620 and the tie plate 610 are anchored together by a pair of long pins 626 that extend through each of the slots 614 and through each of the cleats 620, at the holes 624 where their extended ends are fitted with a suitable pin to prevent dislodgement during transit.

Figure 20A:
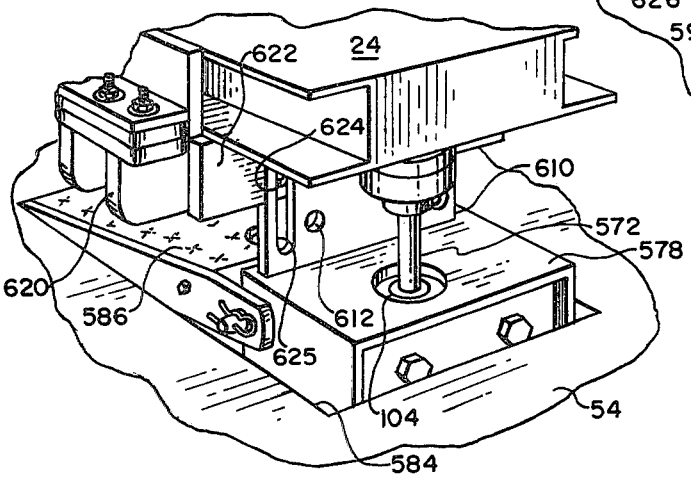
Figure 20B:
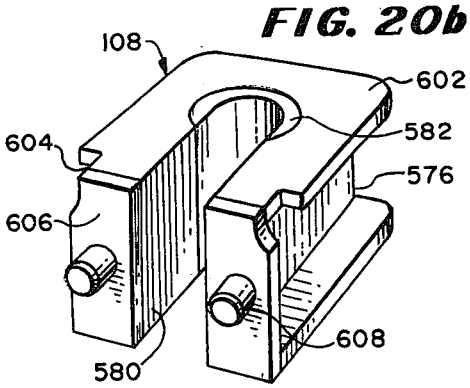

As viewed in FIG. 20*a* the bottom left hand sweep 24, on being folded up for transit would have swung from left to right. The piston rod 572 would be retracted at this time and, under the guidance of the operator, the sweep is brought to the end of its swing with the block 622 against the edge of the tie plate 610. The plate 610 is held firmly within the box member 574, but with enough play to facilitate the alignment of the slots 614 with the holes 624. The bolts or pins 626 are inserted and the sweep can no longer pivot.

The cylinder 104 is operated to extend the rod 572 into the cup 570 to raise the end of the sweep and the plate 610, within the vertical limits allowed by its mounting in the box member 574. This alloww sufficient clearance to insert the block member 108 and engage the pins 608 in the holes 612 of the tie plate 610. Upon retraction of the cylinder 104 the weight is taken by the block and the box member. Reversal of this procedure frees the sweep for rotation to its 120° position about the mast.

A rotating ride of this nature must combine safety with ease of operation and accomodate the passenger loads in quick succession for the greatest momentary return per hour of operation. In order to meet these requirements it is necessary that the ride have a low profile in the area of the mobile unit which will be used by the passengers. Also that area must be free from obstructions.

Figure 21:
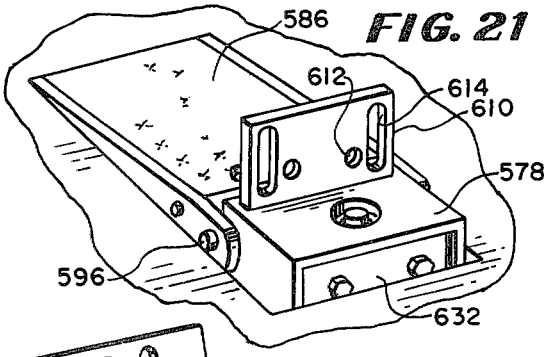
FIGS. 21 to **21*c* show in perspective the manner in which the cylinder casing folds away and is covered so that the deck 54 is clear of obstructions and FIG. 22** is a enlarged fragmentary perspective view of the stiff leg anchor and up-stop assembly.
Figure 21A:
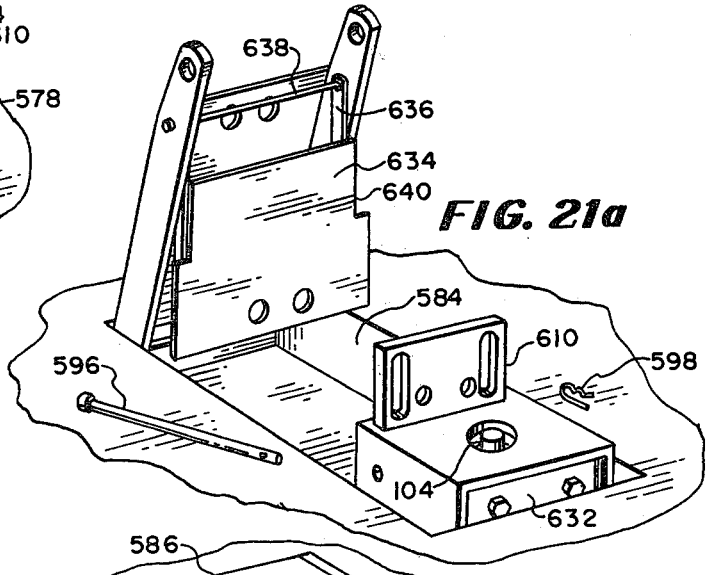

Therefore it was necessary to use a short stroke cylinder 104 and provide means whereby it could be recessed and not interfere with the passengers footing. Accordingly the assembly 108 of FIG. 20 is assigned to collapse and fold up into the form shown in FIG. 21*c*.

Figure 21B:
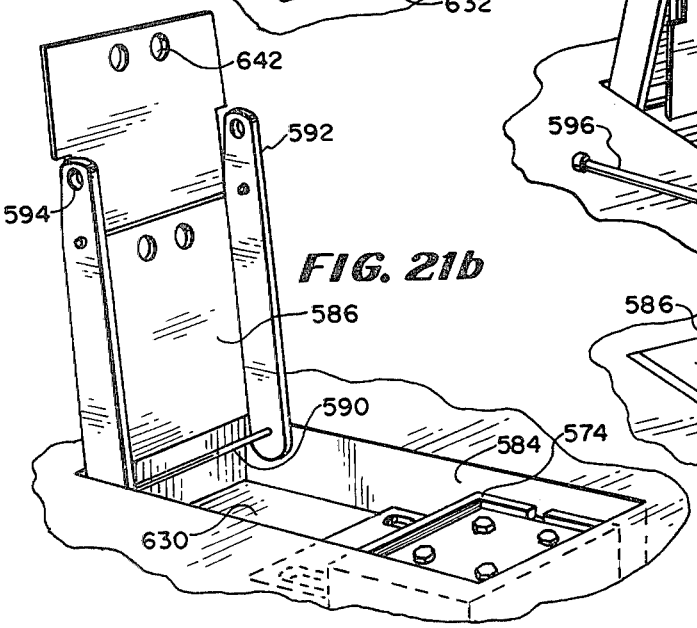
Figure 21C:
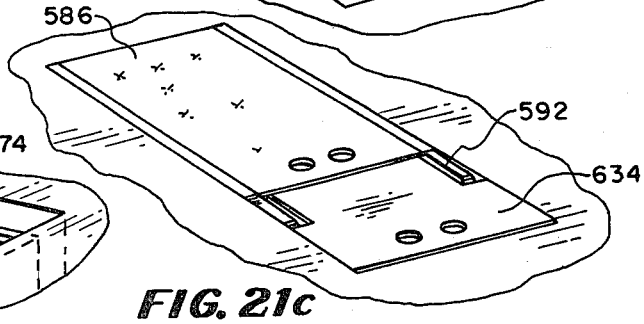

This is accomplished by pivoting the box member 574 along its front bottom corner within the recess 584 so that it can be pivoted as shown in FIG. 21*b* (with its front side in relation to the front of the trailer) and lies flat on the bottom 630, and, by providing that the axis of dimension through the top surface 578 to the opposite side is greater than the depth of the recess 584 and the axis or dimension through the side 632 is no greater than the depth of the recess. Thus the box member 574 can be moved from the position shown in FIG. 21*a* to the position of FIG. 21*b*.

As shown in FIGS. 21 and 21*a* the removal of the pin 596 allows the plate 586 to hinge upwardly on its pivot 590, exposing the secondary plate 634 that was inside the recess. The plate 634 has the cleats 636 and is hinged between the cleats 592 of the cover 586 by the pin 638. The side and corner edges of the plate 634 are cut out at 640 so as to clear the cleats 592 and the two plates can be hinged to a coplanar position, and, then dropped to the cover position shown in FIG. 21*c*. To facilitate this the finger holes 642 are provided.

A last specific aspect of this invention is shown in FIG. 22 wherein the stiff leg anchor 249 is shown in greater detail to include the bifurcated lever 650, pivoted to the inside the top mast housing 152 by means of the pivot 652.

The plate 654 fastened between the legs of the lever 650 provides a support for the bottom end of a bolt member 656 that extends through the top plate 657 of the mast to receive the adjusting nut 658 at its extended end. The coil spring 660 encompasses the shank of the bolt 656 and extends in a biasing relationship between the plate 654 and the underside of the top plate 657. The lever 650 is accordingly biased downwardly within the housing 152. Alternately the spring 660 can bias the lever 650 upwardly.

The opposite side walls 190 of the housing 152 have suitable bore holes to receive the long locking pin 661 which can be extended therethrough from one side to the other and locked with a small pin at the extended end.

The lever 650 has a pair of lobes 662 that are adapted to oscillate between the spaced reinforcing plates 663. The lobes 662 and the plates 663 have alignable bores indicated at 664 through which the pin 661 can be driven.

An opening 668 is provided in the top plate 657 to receive the three spaced tabs 670 having aligned bore holes indicated at 672 in the nearest tab to receive a second locking pin. The lever 650 may be pulled down by hand so that the tabs 670 are below the surface 657 while the stiff legs 216 and 218 are swung into position over the tabs. Then the lever 650 is gradually released so that the tabs 672 at their bottom corners can come into alignment and the locking pin inserted. This arrangement greatly facilitates the quick assembly and disassembly of these heavy cumbersome parts.

Another preferred arrangement for the tethering of the fan lights 34 is to connect the harness 540 to an outside pole and the next strand 248 to the other outside pole and from thence to either of the inner poles in sequence.

We claim:

1. In an amusement ride the combination of a mobile base member;

a mast member vertically support on a rotatable axis from sad base member;

three pairs of upper and lower vertically oriented sweeps extending radially from said mast member;

a rotatable substantially vertical unit pole supported at the extended ends of each of said three pairs of sweeps;

two pairs of diametrically opposite seat sweeps extending from the bottom of each of said unit poles in substantially equal circumferential spacing;

a passenger seat removably attached to the ends of each of said seat sweeps in substantially balanced relationship;

said vertically oriented sweeps being longer than said seat sweeps whereby said passenger seats upon rotation about said unit poles pass in spaced relationship with said mast member;

two of said pairs of vertically oriented sweeps being rotatably mounted from said mast member at vertical axes;

a pair of opposite sweeps on each of said unit poles being foldable upwardly and inwardly to a position adjacent said unit poles;

whereby, upon removing the seats from said pair of opposite seat sweeps and folding the respective seat sweeps to said inward position, said two pairs of rotatable sweeps are positionable to and from ride positions and to and from a transport position with said unfolded seat sweeps oriented about their unit poles in substantially parallel contiguous relationship on each side of said third pair of upper and lower sweeps.

2. An amusement ride in accordance with claim 1 in which each of said second pairs of seat sweeps are pivotally mounted at their inner ends to the respective unit pole whereby to be moved arcuately in to a vertical folded position adjacent thereto;

a diagonal linkage is connected from the top of each of said unit poles to the outer ends of said seat sweeps;

said diagonal linkage having a pivot point intermediate its ends whereby upon folding said seat sweep to said vertical position said pivot point moves into adjacency with said unit pole; and a latch means is provided between said linkage and said unit pole at said point of adjacency.

3. In an amusement ride the combination of a mobile base member;

a mast member vertically supported on a rotatable axis from one end of said base member;

at least two pairs of upper and lower, vertically oriented sweeps extending radially from said mast member;

a rotatable substantially vertical unit pole supported at the extended ends of each of said pairs of sweeps;

a pair of diametrically opposite seat sweeps extending from the bottom of each of said unit poles;

a passenger seat fixed to the ends of each of said seat sweeps in substantially balanced relationship;

said vertically oriented sweeps being longer than said seat sweeps whereby said passenger seats upon rotation about said unit poles pass in spaced relationship with said mast member;

one of said pairs of vertically oriented upper and lower sweeps being rotatably mounted from a common vertical axis from said mast member, whereby to be positionable to and from a diametrically opposite ride position and to and from a side-by-side transport position with said other pair of upper and lower sweeps at the other end of said base member, with said seat sweeps oriented about their unit poles in substantially parallel contiguous relationship, the axis of which extends longitudinally of said mobile unit;

a vertically extensible jack member supported by said base member at the transport position of and axially aligned with each of said unit poles and adapted to extend thereagainst and take the weight of said sweeps and seats from said mast member;

a block member positionable between said base member and each of said unit poles to support said unit poles upon retraction of said extensible jack members;

said extensible jack members are recessed within the bed of said base member;

means are provided to cover said extensible jack members in their recessed positions;

said base member includes a top surface which defines a recess;

each said jack member is contained within a housing member within said recess;

said housing member being rotatable to a first position raising said jack member to an operable axially aligned position above the surface of said base member to engage its respective unit pole and to a second position with said jack member at 90° thereto and with said housing below said top surface of said base member; and cover means to extend over said recess substantially coplanar with said top surface in the second position of said jack member.

4. An amusement ride including a mobile base member;

a mast member rotatably supported on a vertical axis from said base member;

at least two pairs of upper and lower sweep arms extending radially from said mast member;

a rotatable unit pole supported at the extended ends of each of said pairs of sweeps;

seat means suspended from said unit poles to accommodate passengers;

a lever member pivotally mounted from the top of said mast member;

lighting assemblies pivotally mounted to said mast member on a side opposite the pivot point of said lever member;

a linkage connected between one end of said lever and each of said lighting assemblies;

an elongated tie rod pivotally connected to the ends of each of said lighting assemblies;

a linkage member connected between the ends of each of said unit poles and said elongated tie rods;

a counter balance member pivotally mounted on each of said unit poles and having a linkage connected to a point intermediate the ends of said linkage member whereby to balance said tie rod linkage over dead center; and power means connected to said lever member whereby to raise and lower said lever member and cause said lighting assemblies to pivot from a folded position to an upright display position.

5. An amusement ride in accordance with claim 4 in which;

said counter balance members are light panels for display on said unit poles.

6. An amusement ride in accordance with claim 4 including;

a resilient rest member on said top sweeps for each of said tie rod linkages biasing said tie rod linkages past dead center.

7. An amusement ride in accordance with claim 4 wherein;

one of said top sweeps supports an array of pole lights;

said pole lights being side-by-side and pivotally mounted on said top sweeps from a common pivot axis and having their other ends extending toward said unit poles, cable means fastened at one end from each of said top sweeps to said pole lights in sequence, the other end of said cable means being affixed to said lighting assembly whereby on operation of said lower means said pole lights fan out upwardly in an array.

8. An amusement ride in accordance with claim 7 in which said pivot means for said pole lights comprises a series of axially aligned hinged members having laterally movable hinge plates;

said fan lights are contiguous and closely spaced in their folded positions as allowed by the lateral movement of said hinge plates and guide means are provided to maintain said spacing during folding and unfolding.

9. An amusement ride comprising:

a mobile unit providing support for said ride at a location;

a mast member supported by said mobile unit, having a hexagonal sided base, an intermediate section and a top section, said intermediate section defining three coplanar equilateral top edges;

said top section comprising three panel members each extending upwardly from one of said top edges and arranged in equilateral relationship;

three pairs of top and bottom sweep members extending from said mast, the top sweep member of each pair being affixed to the bottom edges of a respective panel member and the bottom sweep members extending from alternate sides of said hexagonal base;

said pairs of sweeps being oriented at an angle of about 120° around said mast member;

a vertical unit pole rotatably connected between the extended ends of each pair of top and bottom sweeps;

means radially suspending a series of four circumferentially spaced and diametrically balanced passenger seats from each of said unit poles;

tie rod means extending from the top of each unit pole to the top of each of said panel members;

means to rotate said mast member in a selected direction in relation to said mobile unit;

means to rotate said unit masts in a selected direction in relation to said top and bottom sweeps;

said three panel members comprises a central panel member and two outer panel members;

a mast lever pivotally supported on said top edge of said intermediate section at a corner opposite said central panel;

one end of said mast lever being connected to an extensible member pivotally supported by said mast member and the other end being connected to the top of said central panel through a secondary linkage;

means to attach the outer edges of said outer panel members to said mast lever in said equilateral relationship;

the inner ends of each top sweep being hinged to the bottom edge of each of said panel members;

the inner ends of the bottom sweep associated with said central panel being affixed to a side of said hexagonal base;

the inner ends of the bottom sweeps associated with said outer panels each being pivotally mounted from said base at pivot points axially aligned with the hinges at the side edges of said outer panels;

said tie rod means including a pivot intermediate its ends to define a short end linkage and a longer main linkage;

stop means supported by said top sweeps to engage said short end linkage and maintain said intermediate pivot above dead center; and an opposite pair of said passenger seats being removable and the associated suspension means being foldable to a position adjacent said unit pole, whereby upon release of said attaching means, between said outer panel member and said mast lever said outer panels and their associated sweeps and remaining seats are rotatable about said aligned pivots and hinges to contiguous positions on each side of said central panel and its associated sweeps and seats and upon release of said stiff legs and operation of said extensible member said panel members and said tie rods are foldable on top of said top sweeps to assume a compact travel position.

10. An amusement ride in accordance with claim 9 in which said means releasably holding said panels comprises:

a pair of leg members provided on the inner side of said central panel;

said leg members being laterally spaced and pivotally mounted therefrom on vertical axes;

the extended ends of said leg members being spaced outwardly from said central panel; and anchor means carried by said mast member engages the extended ends of said leg members to brace said central panel in its upright equilateral position.

11. An amusement ride in accordance with claim 10 in which said leg members have downwardly directed tabs with bore holes therein at their extended ends and are pivotable to a position over said mast with said bore holes in axial alignment;

said anchor means comprises a lever housed by said mast member;

said lever having at least a pair of spaced tabs extending upright therefrom with bore holes in said tabs;

means biasing said lever in an upward position whereby said lever is retractable to clear the tabs on said leg members as they pivot into alignment and releaseable to a position wherein its spaced tabs and bore holes register with the tabs on said leg members; and pin means are provided to lock said tabs together.

12. An amusement ride in accordance with claim 11 including means to lock said anchor lever to said mast member in its upper position of engagement with said locking pin.

13. In an amusement ride the combination of;

a mast member having a base member and a three-sided top section;

a central panel member hinged transversely along one side of said top section to assume a fold-down position and an upright position;

lever means pivotally mounted at the corner of said top section opposite said one side;

power means to pivot said lever means from a fold-down position to an upright position;

a linkage member connected between said top end of said lever means and the top of said central panel member whereby on operation of said power means said central panel member is movable from said fold-down position to said upright position substantially parallel to said lever means;

an outer panel member on each side of said central panel member and hinged thereto along the contiguous sides whereby to be pivotable coplanar with said central panel in the fold-down position of said central panel and pivotable with their outer edges adjacent said lever means in the upright position of said central panel;

means to attach said outer edges of said outer panel members to said lever means in the upright position;

a top sweep member extending in pivotable relationship from the bottom edge of each of said panel members;

a bottom sweep member extending in pivotal relationship from said base member;

a unit pole rotatably mounted between the extended ends of vertically spaced pairs of said top and bottom sweep members;

at least a pair of seat sweeps extending substantially diametrically from and rotatable with each of said unit poles with passenger seats at their extended ends;

a tie rod member extending from pivot means at the top of each of said panel members to the extended ends of said top sweep members, said tie rod members including a link member at the extended end pivoted to said unit poles;

a counter balance means pivotally supported by each of said unit poles, a second link member connected at one end to each of said counter balance means and at the other end intermediate the ends of each of said link members; and a resilient stop member on each of said top sweep members and engageable with said link member in the upright position of said panel members whereby to maintain the pivotal link members off dead center in cooperation with said counter balance of said panels begin the fold-down position upon the release of said attachment means and operation of said power means.

14. An amusement ride in accordance with claim 13 including:

two pairs of radial seat sweeps with passenger seats at their extended ends supported from each of said unit poles and rotatable therewith;

opposite pairs of said seat sweeps on each unit pole being hinged to each unit pole at their inner ends and having removable seats;

each of said hinged seat sweeps having a centrally hinged diagional brace that is hinged to the entended end of its respective seat sweep and to the top of its respective unit pole whereby to collapse downwardly at said central hinge upon raising the end of said seat sweep;

cooperating latch members at said central hinge of each diagonal brace and its respective unit pole, said latch members engaging to hold said hinged seat sweep in a neutral position adjacent said unit poles as the remaining opposite seats are rotated to transit positions with their seat sweeps in parallel adjacent positions.

* * * * *